US008186792B2

(12) United States Patent
Otani

(10) Patent No.: US 8,186,792 B2
(45) Date of Patent: May 29, 2012

(54) TIMING SIGNAL GENERATOR AND LIQUID EJECTING APPARATUS INCORPORATING THE SAME

(75) Inventor: Katsuhiko Otani, Shimosuwa-machi (JP)

(73) Assignee: Seiko Epson Corporation, Tokyo (JP)

( * ) Notice: Subject to any disclaimer, the term of this patent is extended or adjusted under 35 U.S.C. 154(b) by 1099 days.

(21) Appl. No.: 11/588,659

(22) Filed: Oct. 27, 2006

(65) Prior Publication Data

US 2007/0103496 A1 May 10, 2007

(30) Foreign Application Priority Data

Oct. 28, 2005 (JP) ..... P2005-314690
Oct. 28, 2005 (JP) ..... P2005-314691
Oct. 26, 2006 (JP) ..... P2006-291113

(51) Int. Cl.
*B41J 29/38* (2006.01)
*B41J 2/115* (2006.01)

(52) U.S. Cl. ..... 347/11; 347/80

(58) Field of Classification Search ..... 400/124.07, 400/124.05; 347/14, 11, 110, 37, 80
See application file for complete search history.

(56) References Cited

U.S. PATENT DOCUMENTS 4,372,696 A * 2/1983 Pou ..... 400/124.07
5,439,301 A * 8/1995 Nishizawa ..... 400/124.05
5,748,206 A * 5/1998 Yamane ..... 347/37
6,354,690 B1 3/2002 Murakami
6,412,897 B1 * 7/2002 Konishi et al. ..... 347/14

FOREIGN PATENT DOCUMENTS

| | | | |
|---|---|---|---|
| JP | 9-136465 | | 5/1997 |
| JP | 9136465 | * | 5/1997 |
| JP | 11-277808 | A | 10/1999 |
| JP | 11-334149 | | 12/1999 |
| JP | 11-334149 | A | 12/1999 |
| JP | 2003072177 | A | 3/2003 |
| JP | 2003-211767 | A | 7/2003 |
| JP | 2003-225999 | A | 8/2003 |
| JP | 2004-50771 | | 2/2004 |

* cited by examiner

*Primary Examiner* — Stephen Meier
*Assistant Examiner* — Carlos A Martinez
(74) *Attorney, Agent, or Firm* — Nutter McClennen & Fish LLP; John J. Penny, V.

(57) ABSTRACT

A signal generating device to be installed in a liquid ejecting apparatus which comprises a liquid ejector operable to eject liquid and a carriage operable to carry the liquid ejector, the signal generating device comprising: a first generator to generate first pulse signals at first intervals corresponding to a velocity of the carriage; an estimator to estimate an interval of the first pulse signals which will be generated by the first generator based on a variation of an acceleration of the carriage as a second interval; a second generator to generate second pulse signals at third intervals which are obtained by dividing the second interval; and a third timing signal generator to generate a timing signal determining a timing at which the liquid is ejected from the liquid ejector, based on the second pulse signals.

15 Claims, 14 Drawing Sheets

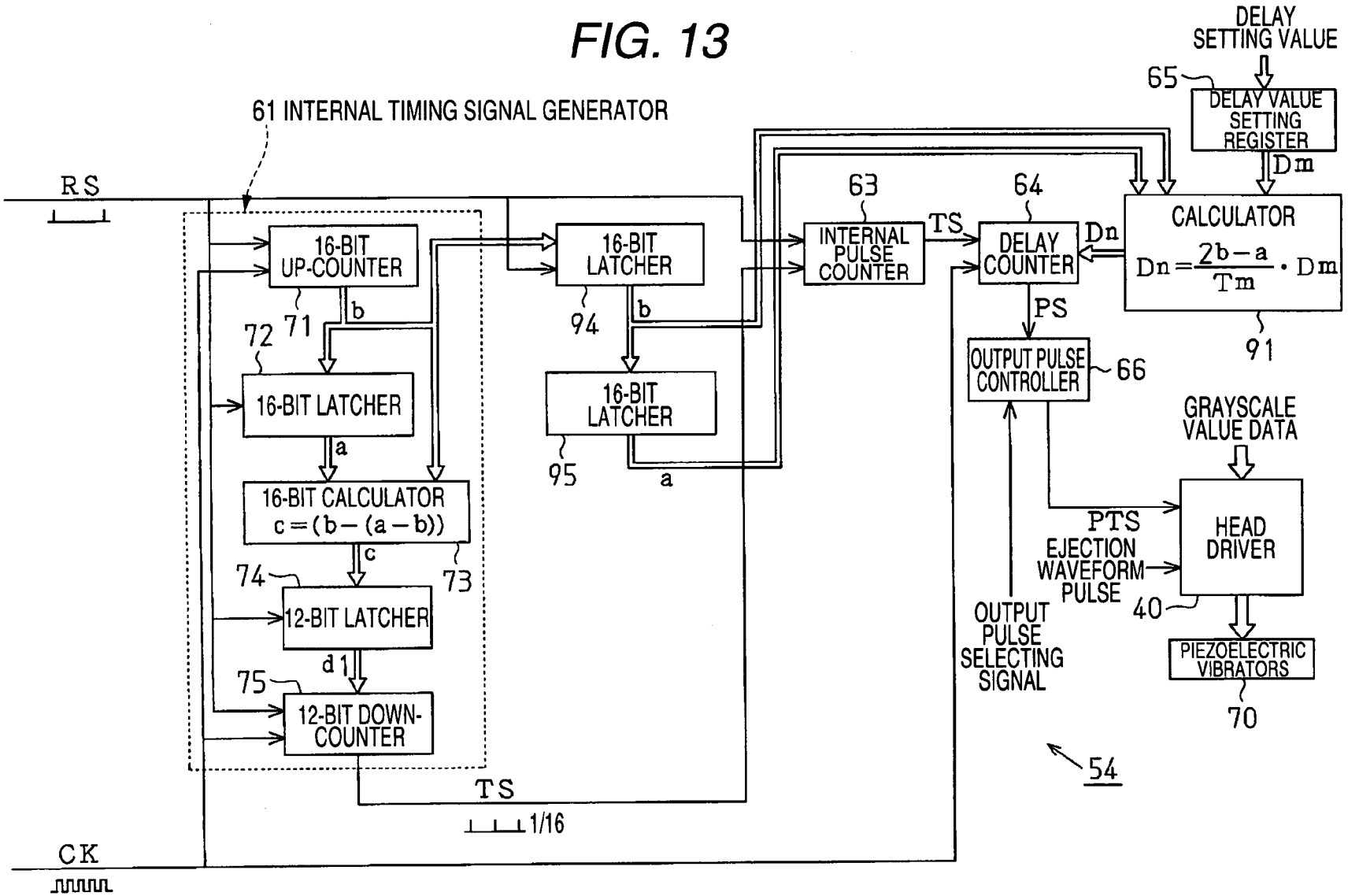
FIG. 13
61 INTERNAL TIMING SIGNAL GENERATOR
DELAY SETTING VALUE
65
DELAY VALUE SETTING REGISTER
Dm
CALCULATOR
Dn = (2b − a)/Tm · Dm
91
GRAYSCALE VALUE DATA
HEAD DRIVER
40
PIEZOELECTRIC VIBRATORS
70
Dn
64
DELAY COUNTER
PS
66
OUTPUT PULSE CONTROLLER
PTS
EJECTION WAVEFORM PULSE
OUTPUT PULSE SELECTING SIGNAL
54
TS
63
INTERNAL PULSE COUNTER
16-BIT LATCHER
94
b
16-BIT LATCHER
95
a
TS
1/16
16-BIT UP-COUNTER
71
b
16-BIT LATCHER
72
a
16-BIT CALCULATOR
c = (b − (a − b))
73
c
12-BIT LATCHER
74
d 1
12-BIT DOWN-COUNTER
75
RS
CK

TIMING SIGNAL GENERATOR AND LIQUID EJECTING APPARATUS INCORPORATING THE SAME

BACKGROUND

1. Technical Field

The present invention relates to a signal generating device that generates a timing pulse signal determining a liquid ejection timing in a liquid ejecting apparatus, such as an ink jet printer or the like, and to a liquid ejecting apparatus incorporating such a signal generating device.

2. Background Art

A printer has an encoder that is provided to detect a position of a movable body, such as a carriage or the like, and the position of the movable body is detected by counting the number of pulses of a pulse signal to be output from the encoder. Further, during the movement of the movable body, such as a carriage or the like, an ink droplet is ejected from a printing head mounted on the carriage and then is landed at a target position on a recording medium, such as paper or the like, so that printing is performed.

The carriage reciprocates in a primary scanning direction, and there is a flight time period until the ink droplets ejected from the printing head are landed on the paper. Accordingly, during the flight time period, the ink droplets move in a moving direction of the carriage (that is, the moving direction of the printing head). For this reason, even when the carriage reaches the same position upon both the forward movement and the backward movement, actual landing positions of the ejected ink droplets are deviated along the moving direction of the carriage, and the actual landing position and a target landing position are deviated from each other. The actual landing position is deviated from the target landing position, that is, a so-called bi-directional deviation occurs. For this reason, an ejection timing of the ink droplets from the printing head is controlled so that the bi-directional deviation can be prevented so as to allow the ink droplets to be accurately landed at the target landing position.

Japanese Patent Publication No. 9-136465A (JP-A-9-136465) discloses a signal generating device that generates a plurality of signals by dividing an encoder signal for high-resolution printing. In this device, a pulse width of the encoder signal is measured (counted), and the count value is divided. Then, the divided value is counted down by a down-counter, and a BORROW signal for performing a shift is counted by an internal pulse counter. The internal pulse counter creates 16 internal pulse signals by counting 16 BORROW signals and generates an output timing of each internal pulse signal for each count value set in an output pulse controller. Therefore, a printing signal that has a cycle different from that of the encoder signal is output. With this configuration, even though the movement velocity of the movable body is varied, it is possible to generate the internal timing signal so as to correspond to the movable body.

Further, the ejection of the ink droplets from the printing head is normally performed in a constant-velocity region of the carriage. For example, Japanese Patent Publication No. 2004-50771A (JP-A-2004-50771) discloses a printer that widens a printing region by ejecting ink droplets in an accelerating region of the carriage.

However, the signal generating device disclosed in JP-A-9-136465 divides the pulse width of the previous encoder signal (1/n) and generates an internal timing signal. In this case, the constant-velocity region or a velocity changing region where a change in pulse width of the previous encoder signal and a change in pulse width of the current encoder signal are small is assumed. Specifically, the known signal generating device generates the internal timing signal by dividing the measured pulse width of the encoder signal into 16 segments. Accordingly, when a change between a previous encoder cycle and a current encoder cycle is 1/16 (6.25%) or more, it is difficult to generate the prescribed number of internal timing signals.

FIG. 15A is a timing chart when an internal timing signal in an accelerating region of a movable body is generated in the same manner as that in JP-A-9-136465. As shown in FIG. 15A, a reference pulse of a rising edge detector is obtained from the encoder signal, and a count value for one cycle (cyclic count value) is obtained by counting a cycle of the reference pulse using an up-counter. Then, a BORROW signal to be output when a value (for example, "4") obtained by dividing the previous cyclic count value (a value regarded as a current cyclic count value) by a prescribed number (for example, "8") for division of one cycle (cyclic count value: for example, "32") is counted down by a down-counter is counted by an internal pulse counter and a pulse is generated for each count. Accordingly, an internal timing signal having a plurality (for example, "16") of pulses is generated per a cycle of the reference cycle.

As shown in FIG. 15A, upon rapid acceleration or deceleration for performing high speed printing, the change between the encoder cycles TA and TB becomes large, the internal timing signal generated each time the value (in this example, CA/n=4) obtained by dividing the cycle TA (cyclic count value CA) by a prescribed number n is counted down cannot be output for the next one cycle TB by a prescribed number (for example, seven). That is, for the cycle TB, seven internal timing signals have to be generated, but only five internal timing signals can be generated, as shown in FIG. 11A. In addition, at the next cycle TC, similarly, since the change between the encoder cycles TB and TC is large, only five internal timing signals, not seven, are generated.

In addition, as shown in FIG. 15B, even though the prescribed number (eight) of internal timing signals can be generated, a time interval tx between the eighth output and the next first output is made extremely short compared with other time intervals (cycle TB). In such a circuit configuration, there is a problem in that a correct print timing signal cannot be obtained in the accelerating region. Further, in order to obtain a higher-resolution image, when the number of output internal timing signals to be generated per a cycle of the reference cycle increases by increasing the number of divisions of the reference pulse, the above problem more drastically occurs.

Also Japanese Patent Publication No. 11-334146A (JP-A-11-334146) discloses a background art of the invention.

SUMMARY

It is therefore one advantageous aspect of the invention to provide a signal generating device that can output an appropriate ejection timing signal during accelerating/decelerating of a movable body, and to provide a liquid ejecting apparatus incorporating such a signal generating device.

According to the invention, there is provided a signal generating device, adapted to be installed in a liquid ejecting apparatus which comprises a liquid ejector operable to eject liquid and a carriage operable to carry the liquid ejector, the signal generating device comprising:

a first generator, operable to generate first pulse signals at first intervals corresponding to a velocity of the carriage;

an estimator, operable to measure at least one of the first intervals of the first pulse signals which have been generated by the first generator, and operable to estimate an interval of the first pulse signals which will be generated by the first generator based on the at least one of the first intervals as a second interval;

a second generator, operable to generate second pulse signals at third intervals which are obtained by dividing the second interval; and a third generator, operable to generate a timing signal determining a timing at which the liquid is ejected from the liquid ejector, based on the second pulse signals.

BRIEF DESCRIPTION OF THE DRAWINGS

FIG. 13 is a block diagram showing a print timing generator according to a fifth embodiment of the invention.

DETAILED DESCRIPTION OF EXEMPLARY EMBODIMENTS

Exemplary embodiments of the invention will be described below in detail with reference to the accompanying drawings.

Figure 1:
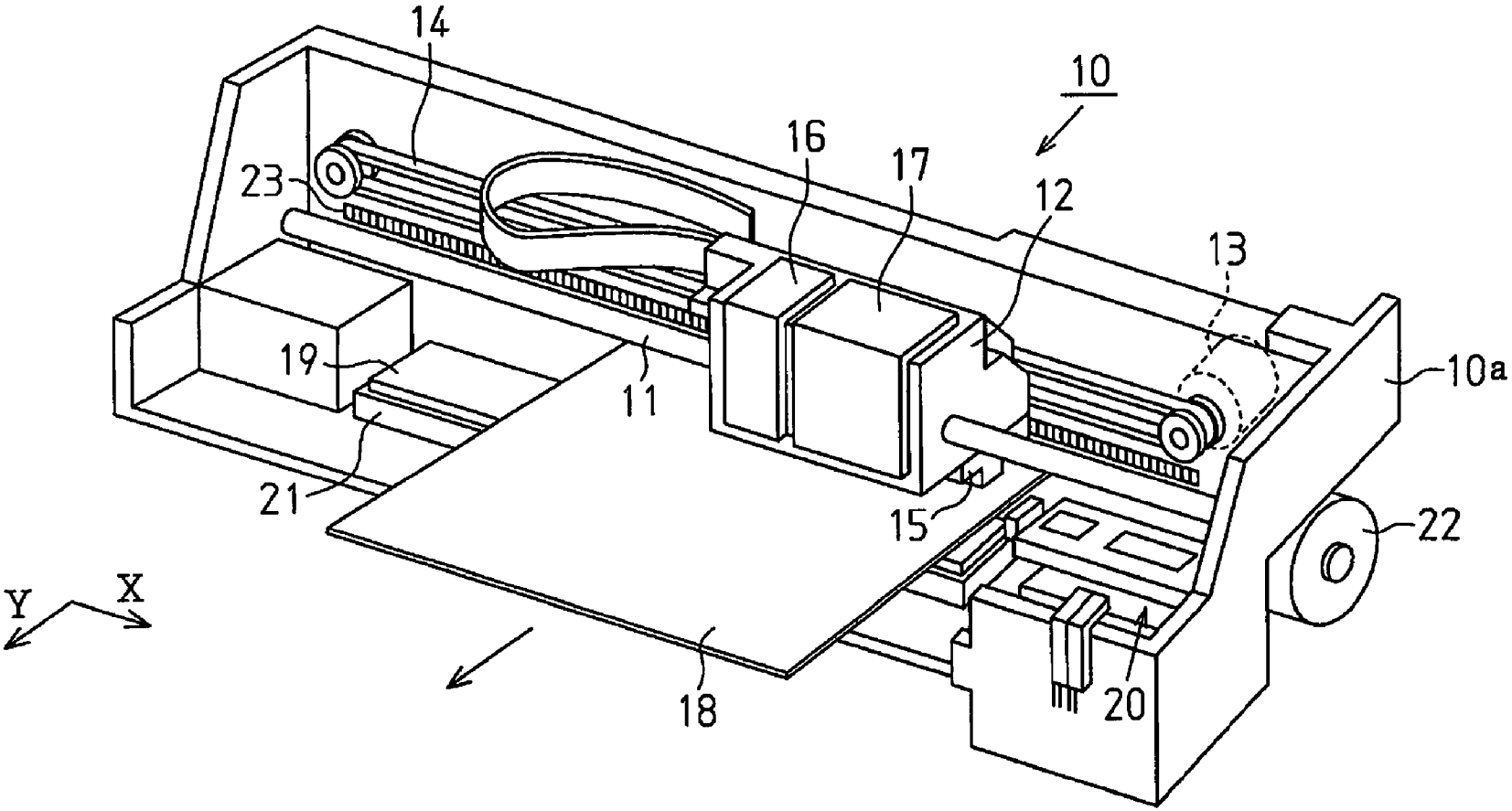
FIG. 1 is a perspective view of a printer according to a first embodiment of the invention.

As shown in FIG. 1, the ink jet printer (hereinafter, referred to as "printer 10") serving as a liquid ejecting apparatus according to a first embodiment of the invention has a printer body 10*a* provided in an external casing (not shown). A carriage 12 is provided in the printer body 10*a* so as to reciprocate in a primary scanning direction (X direction in FIG. 1) by being guided by a guiding shaft 11. The carriage 12 is fixed to a part of an endless timing belt 14 which is circulated when a carriage mortar 13 is driven. The carriage motor 13 is bidirectionally driven so that the carriage 12 reciprocates in the primary scanning direction. In this embodiment, although a DC motor is used as the carriage motor 13, a stepping motor may be used as the carriage motor 13.

A printing head 15 serving as a liquid ejecting head is provided under the carriage 12. On the carriage 12, a black ink cartridge 16 and a color ink cartridge 17 which supply a plurality kinds of ink to the printing head 15 are detachably mounted on the carriage 12. A nozzle forming face in which a plurality of nozzles are formed for every color is provided under the printing head 15.

The printing head 15 includes a piezoelectric vibrator (not shown) for every one nozzle. When a voltage is applied to the piezoelectric vibrator corresponding to a nozzle which will eject an ink droplet, the piezoelectric vibrator is vibrated due to an electrostrictive effect. And then, an ink chamber provided in the printing head 15 so as to be partitioned per nozzle is expanded or compressed so that the ink droplets are ejected from each nozzle.

Since the carriage 12 reciprocates in the primary scanning direction X along the guiding shaft 11, both end regions of a movement range become an accelerating/decelerating region in which the carriage 12 decreases a velocity to change a moving direction or increases the velocity after changing the moving direction. In this embodiment, an acceleration/deceleration printing is performed, in which the ink droplets is ejected not only in a constant velocity region but also in the accelerating/decelerating region of the carriage 12.

A flat platen 19 which defines a gap between the printing head 15 and a printing paper 18 is placed below the carriage 12 while a longitudinal direction thereof is matched with an axial direction of the guiding shaft 11. In FIG. 1, a cleaning device 20 (maintenance device) which cleans the printing head 15 is provided in a position corresponding to a home position which is the end portion of the movement range of the carriage 12. Further, a waste liquid tank 21 is placed under the platen 19 so as to receive the waste liquid ejected from the cleaning device 20.

Printing paper 18 is fed when a sheet feeding roller is rotated by a sheet feeding motor 22. The printing paper 18 is inserted in a delivery roller driven by the sheet feeding motor 22 and then delivered to a secondary scanning direction Y. The carriage 12 moves in the primary scanning direction from the printing head 15 while ejecting the liquid droplet and the printing paper 18 is delivered by a prescribed pitch, and the movement of the carriage 12 and the deliver of the printing paper 18 are alternatively performed so that a printing is performed on the printing paper 18.

Further, a linear encoder 23 is provided in the printer 10 along the guiding shaft 11. The linear encoder 23 includes a detection tape (hereinafter, referred to as "slit tape 24") in which, for example, 180 slits 24*a* are formed between one inches (25.4 mm) at regular intervals, and a sensor 25 (see FIG. 2). The slit tape 24 is set to be parallel to the primary scanning direction (carriage moving direction) in the back of the movable region of the carriage 12.

Figure 2A:
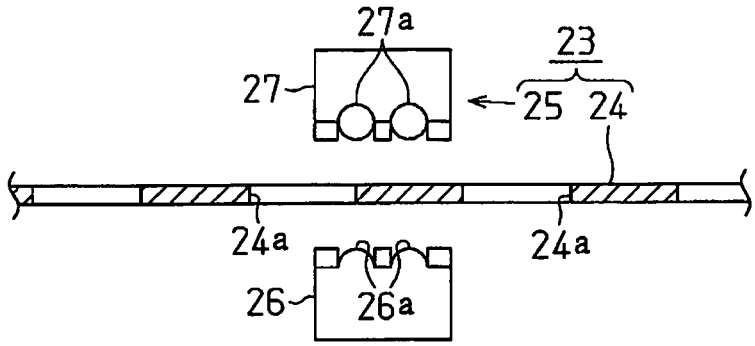
FIG. 2A is a plan view of a linear encoder in the printer.
Figure 2B:
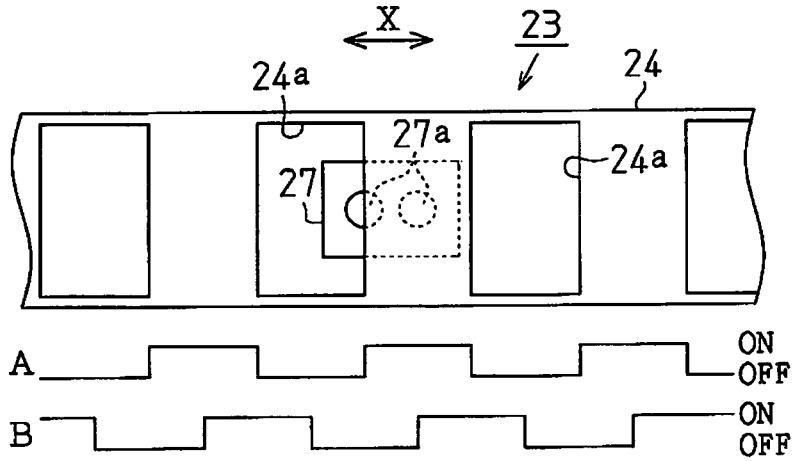
FIG. 2B is a front view of the linear encoder, showing a relationship between a structure thereof and a signal outputted therefrom.

As shown in FIG. 2A, the sensor 25 includes a light emitting element 26, a light receiving element 27 opposing the light emitting element 26, and the slit tape 24 interposed therebetween. The light emitting element 26 has a pair of light emitting sections 26*a* and the light receiving element 27 has a pair of light receiving sections 27*a* which position to have the same interval as each of the light emitting sections 26*a* in the X direction. The light emitting sections 26*a* are positioned to be opposite to the light receiving sections 27*a*, respectively. The interval of the slit arrange direction (longitudinal direction of the slit tape) between the pair of light receiving sections 27*a* is set to a value in which an encoder signal A is deviated from an encoder signal B by ¾ cycle. Each of the encoder signals A and B are output from the light receiving sections 27*a*. The linear encoder 23 including the slit tape 23 outputs an encoder signal (detection signal) having a number of pulses corresponding to the number of light which passes through each of the slits 24*a* when the carriage 12 is scanned. Two kinds of encoder signals A and B which are deviated by ¾ cycle are output from the sensor 25.

Figure 4:
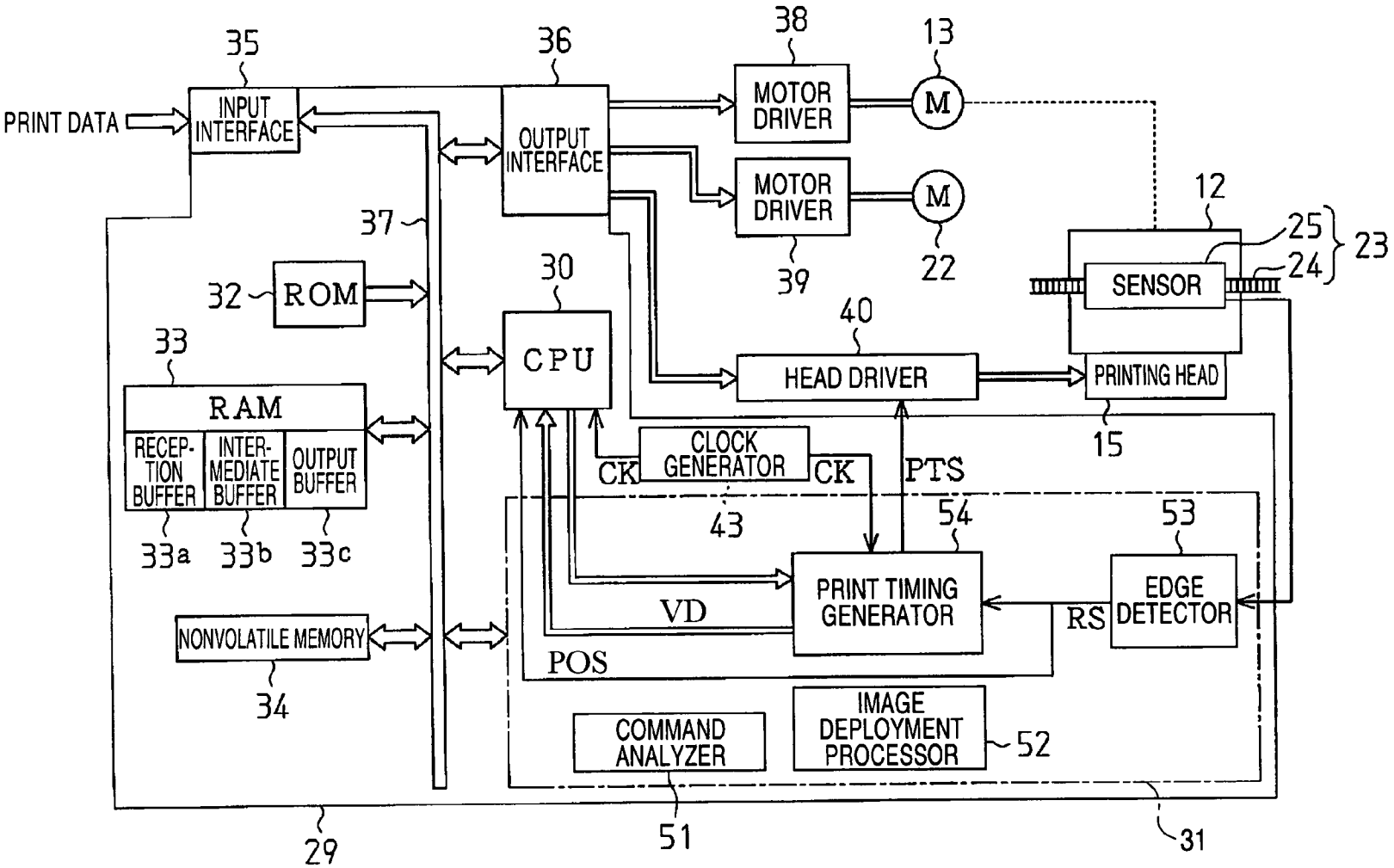
FIG. 4 is a block diagram showing electrical configuration of the printer.

As shown in FIG. 4, the printer 10 includes a controller 29, motor drivers 38 and 39, and a head driver 40. The controller 29 controls to drive the carriage motor 13 through the motor driver 38 and controls to drive the sheet feeding motor 22 through the motor driver 39. Further, the controller 29 controls to drive the printing head 15 (in particular, the piezoelectric vibrator provided for every nozzle) through the head driver 40 on the basis of printing data input from, for example, a host computer (not shown).

The controller 29 includes a CPU (Central Processing Unit) 30, an ASIC (Application Specific Integrated Circuit) 31 serving as a custom LSI, a ROM 32, a RAM 33, a nonvolatile memory (flash ROM) 34, an input interface 35, an output interface 36, and a clock generator 43, and the like. The CPU 30, the ASIC 31, the ROM 32, the RAM 33, the nonvolatile memory 34, the input interface 35, and the output interface 36 are connected to each other through a bus 37.

The ROM 32 stores various control programs and various data. An EPROM is used as the nonvolatile memory 34, specifically, in this embodiment, an EEPROM (electronically erasable and programmable read only memory) that electronically erases the storage is used as the nonvolatile memory. In the nonvolatile memory 34, various programs, such as a firmware program, and various data necessary for a printing process are stored. In the RAM 33, program data to be process by the CPU 30, various data calculated or process by the CPU 30, and various data process by the ASIC 31 are temporally stored. Further, the RAM 33 has a reception buffer 33*a*, an intermediate buffer 33*b*, and an output buffer 33*c* so as to store the printing data, data being processed, and processed data.

When the printer 10 is communicatively connected to the host computer through a communication cable (not shown), the printing data that is to be transmitted to the printer 10 from the host computer is input to the input interface 35. The printing data received by the printer 10 is stored in a reception buffer 33*a* of the RAM 33 through the input interface 35. The ASIC 31 includes a command analyzer 51 that analyzes a command included in the printing data temporally stored in the reception buffer 33*a* and generates an intermediate code, and an image deployment processor 52 that converts the intermediate code stored in the intermediate buffer 33*b* into bitmap data in which a printing dot is expressed by a grayscale value and develops the bitmap data on the RAM 33. The image deployment processor 52 performs the deployment processing on data corresponding to one scan amount so that the bitmap data (grayscale value data) corresponding to one scanning amount is stored in the output buffer 33*c*. Therefore, the bitmap data (grayscale value data) is transmitted to the head driver 40 through the output interface 36 from the output buffer 33*c*.

Further, a motor command signal generated by executing the firmware software (printing control program) by the CPU 30 is output to the motor drivers 38 and 39, respectively, through the output interface 36 so that the carriage motor 13 and the sheet feeding motor 22 are controlled to be driven.

Figure 3:
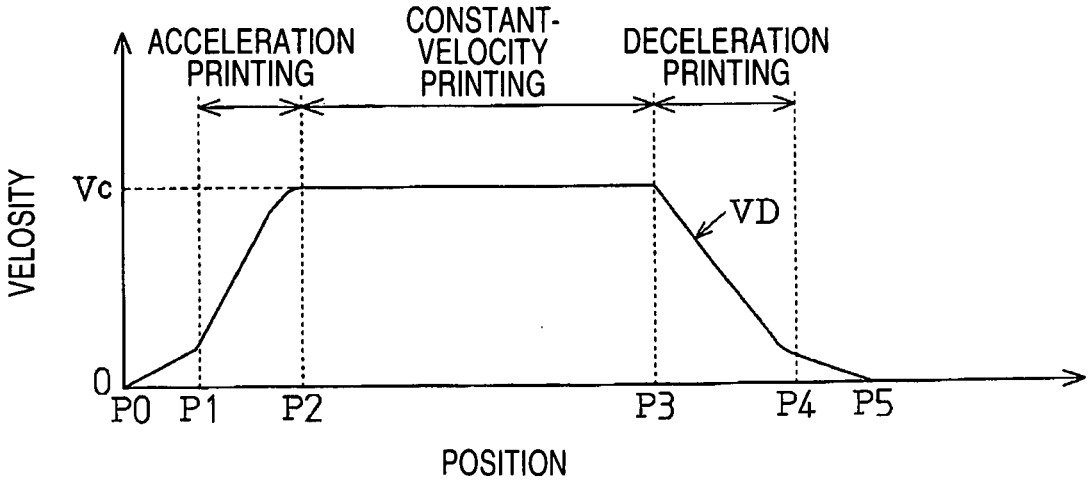
FIG. 3 is a graph showing data for controlling velocity of a carriage in the printer.

FIG. 3 shows velocity control data for the carriage 12. The velocity control data VD is stored in, for example, the nonvolatile memory 34. The velocity control data VD indicates the relationship between a carriage position and carriage velocity. The CPU calculates the carriage velocity from the carriage position obtained on the basis of the encoder signal with reference to the velocity control data VD and performs a feed-back control (for example, PID control) so as for the carriage velocity to be a target value. However, a feed-forward control may be included in a part of the movable range of the carriage 12 (for example, the accelerating/decelerating region). In this embodiment, a section from the origin position P0 to a position P2 is an accelerating region in which the carriage starts to move from a stop state (velocity "0") and moves at a constant velocity Vc. A section from the position P2 to a position P3 is a constant velocity region in which the velocity of the carriage is controlled to be the constant velocity Vc. A section from the position P3 to a position P5 is a deceleration region in which the velocity of the carriage is reduced from the constant velocity Vc to be stopped (velocity "0"). This embodiment adopts the acceleration/deceleration printing and the printable region of the primary scanning direction X (carriage moving direction) is set to a constant velocity printing performed in the constant velocity region, an acceleration printing performed between the positions P1 to P2 among the accelerating region, and a deceleration printing performed between the positions P3 to P4 among the deceleration region. Further, in this embodiment, the printing is performed when the carriage moves back and forth. Therefore, the interval between the positions P0 and P1, the interval between the positions P4 to P5, or the like is set to the same value so that a printing completion position when the carriage moves forth becomes the same as a printing start position when the carriage moves back on the printing paper 18.

Further, as shown in FIG. 4, the ASIC 31 includes an edge detector 53 and a print timing generator 54 used to generate a print timing signal PTS which determines an ejection timing of the ink droplets from the nozzle of the printing head 15. An encoder signal is input from the sensor 25 of the linear encoder 23 to the edge detector 53 and the edge detector 53 detects a rising edge. At this time, the detector 53 generates a pulse whenever the rising edge is detected so as to output a reference pulse signal RS having the same cycle with that of the encoder signal (encoder cycle).

The print timing generator 54 performs a signal generation processing by using the reference pulse signal RS input from the edge detector 53 and a clock signal CK input from the clock generator 43 so as to generate the print timing signal PTS. The signal generation processing performed by the print timing generator 54 includes a cycle dividing processing which divides the cycle of the reference pulse signal RS so as to generate a pulse of the cycle in which the one cycle $i_s$ divided into a plurality of segments and a delay processing which generates an ejection timing signal by delaying the pulse signal obtained in the dividing process by a delay time determined according to the carriage velocity and the carriage moving direction (difference between the back and forth). The print timing signal PTS generated by the print timing generator 54 is output to the head driver 40.

The printing head 15 includes a piezoelectric vibrator (not shown) for every nozzle. When a driving voltage (ejecting pulse) based on the driving signal is applied to each of the piezoelectric vibrators. A partition (ink chamber) is provided for every nozzle due to the electrostriction effect of the piezoelectric vibrator when the driving voltage is applied. The chamber is expanded or compressed so that the ink droplets are jetted (ejected) from each nozzle. The head driver 40 determines a timing when the driving voltage (ejecting pulse) is applied to each of the piezoelectric vibrators on the basis of the print timing signal PTS. The head driver 40 determines one or a plurality of ejecting pulses to be applied to the piezoelectric vibrator among three kinds of ejecting pulses on the basis of a two-bit grayscale value data input from the controller 29. That is, the size of dot, for example, large, middle, or small or no ejection that means the ejecting pulse is not applied will be determined on the basis of the application combination of the ejecting pulses. For example, it may be determined that a grayscale value "00" indicates no ejection, a grayscale value "01" indicates that the dot size is small, a grayscale value "10" indicates that the dot size is middle, and a grayscale value "11" indicates that the dot size is large.

Further, the reference pulse signal RS output from the edge detector 53 is input to the CPU 30 as a position detecting pulse PDS. The CPU 30 recognizes a moving direction of the carriage 12 on the basis of a phase difference between the phases A and B included in the detection signal output from the linear encoder 23. The CPU 30 counts the number of pulses of the position detecting pulse PDS with the counter. The CPU 30 increases the calculated value when the carriage moves forward and decreases the calculated value when the carriage moves backward. Therefore, the CPU 30 detects the position from an original position (for example, home position) of the carriage 12 on the basis of the calculated count value. The position of the carriage 12 is used to control a velocity of the carriage motor 13 executed on the basis of the velocity control data VD (see FIG. 3).

Further, the print timing generator 54 outputs velocity data to the CPU 30. The print timing generator 54 includes an up-counter 71 (see FIG. 5) which counts the cycle of the encoder and outputs data corresponding to a counted value or a reciprocal number thereof serving as the velocity data to the CPU 30 on the basis that the encoder cycle which is the counted value is in inverse proportion to the carriage velocity. In addition, the CPU 30 writes a set value, such as a delay setting value, which will be described later or inputs a selecting signal for a printing mode (output pulse selecting signal) or the like to the print timing generator 54.

Figure 5:
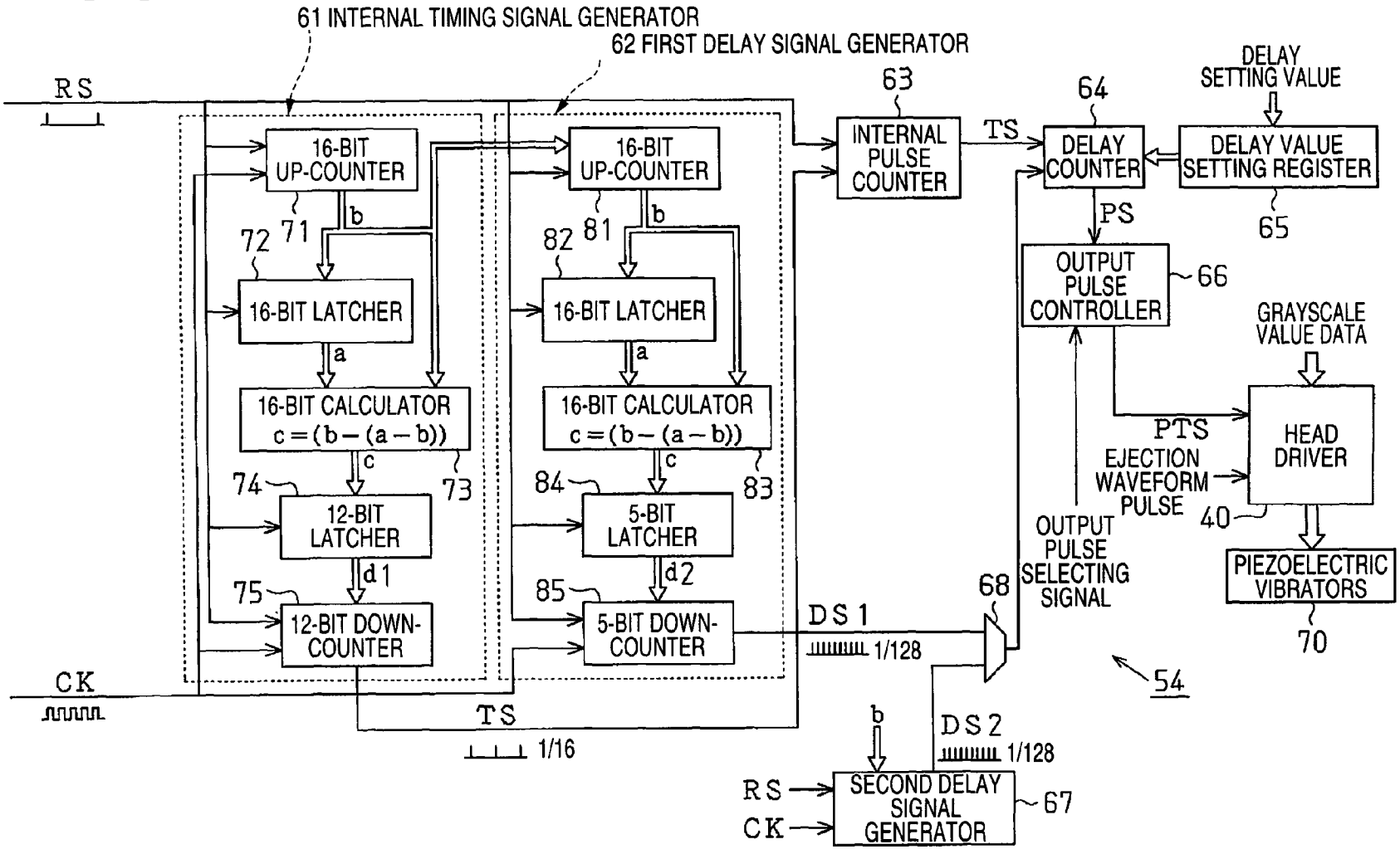
FIG. 5 is a block diagram showing internal configuration of a print timing generator in the printer.

FIG. 5 is a block diagram showing an internal configuration of the print timing generator. As shown in this figure, the print timing generator 54 includes an internal timing signal generator 61, a first delay signal generator 62, an internal pulse counter 63, a delay counter 64, a delay value setting register 65 (hereinafter, referred to as "setting register 65"), and an output pulse controller 66.

The internal timing signal generator 61 performs a cycle dividing processing in which a cycle T of the reference pulse signal RS by "16" and generates an internal timing signal TS having a pulse of T/16 cycle. The first delay signal generator 62 performs the cycle dividing processing in which a cycle T of the reference pulse signal RS is divided so as to generate a first delay signal DS1 having a pulse of 1/128 cycle of the internal timing signal TS. The internal timing signal generator 61 and the first delay signal generator 62 can exactly estimate a current cycle by performing an operation on the basis of an operational expression in which the velocity change of the carriage 12 is reflected in the individual cycle dividing processing. Further, the internal timing signal generator 61 and the first delay signal generator 62 can accurately generate the internal timing signal TS and the first delay signal DS1 by dividing the exact estimated cycle.

The print timing generator 54 further includes a second delay signal generator 67 that generates a second delay signal DS2 obtained by performing the cycle dividing processing with respect to the previous counted cycle without reflecting the velocity change of the carriage 12. The first delay signal DS1 and the second delay signal DS2 are input to a selector 68. Any one of the first delay signal DS1 or the second delay signal DS2 is selected by the selector 68 according to an operation of an operation switch on the printer 10, a setting of manufacture and shipment, or a printing mode selected by a user. Here, the first delay signal DS1 is a delay signal corrected according to the acceleration/deceleration printing (delay signal corrected to be corresponded even when the previous encoder cycle is different from the current encoder cycle of the acceleration/deceleration printing) and is basically selected when the acceleration/deceleration printing is performed. The second delay signal DS2 is a delay signal which is not corrected according to the acceleration/deceleration printing and is used in a printing mode in which the previous encoder cycle is slight different from the current encoder cycle or a printing mode in which a constant-velocity printing is only performed.

The internal timing signal generator 61 includes a 16-bit up-counter 71, a 16-bit latcher 72, a 16-bit calculator 73, a 12-bit latcher 74, and a 12-bit down-counter 75. Further, the first delay signal generator 62 includes a 16-bit latcher 81, a 16-bit latcher 82, a 16-bit calculator 83, a 5-bit latcher 84, and a 5-bit down-counter 85.

First, the internal timing signal generator 61 will be described. The internal timing signal generator 61 estimates a current encoder cycle on the basis of two previous encoder cycles and generates an internal timing signal by diving the estimated current encoder cycle. Therefore, in order to estimate the encoder cycle, an arithmetic processing using the last but one previous encoder cycle and the previous encoder cycle is performed as one processing.

The 16-bit up-counter 71 is connected so that the reference pulse signal RS and the clock signal CK are input, calculates the number of clock pulses of the clock signal CK, and is reset when the reference pulse signal RS is input. Therefore, the up-counter 71 outputs a cyclic count value "b" (cyclic count value) corresponding to the encoder cycle T.

The 16-bit latcher 72 is a circuit that latches the cyclic count value "b" of the up-counter 71 and connected so that the reference pulse signal RS is input. The latcher 72 is reset when the reference pulse signal RS is input. At the same time, the latcher 72 latches the cyclic count value "b" of the up-counter 71. Therefore, the latcher 72 may maintain a cyclic count value "a" corresponding the last but one previous encoder cycle TA.

The 16-bit calculator 73 inputs the cyclic count value "b" of the up-counter 71 and the cyclic count value "a" of the latcher 72 and calculates an output value "c" corresponding to the counter value of the current encoder cycle by using the both cyclic count values "a" and "b". The output value is expressed by "c=[b−(a−b)]". That is, it is an arithmetic expression in which the current encoder cycle TC is calculated by calculating the difference between the last but one previous encoder cycle TA and the previous encoder cycle TB and subtracting the calculated difference from the previous encoder cycle TB. When the carriage 12 which is moving in the accelerating/decelerating region is changing the velocity to a certain acceleration velocity, if the accelerating region is extremely small, it may be assumed that a change amount between the previous encoder cycle and current encoder cycle is the same.

The 12-bit latcher 74 is reset when the reference pulse signal RS is input. At the same time, the 12-bit latcher 74 calculates an output value "c" of the calculator 73. The 16-bit output value "c" is input from the calculator 73 to the latcher 74 and the latcher 74 latches only the upper 12 bits of the output value "c". That is, while the upper 12 bits of the 16-bit output value "c" are latched by the latcher 74, the lower 4 bits are truncated. Therefore, the output value "c" is divided by "16". That is, the latcher 74 serves as a divider and outputs a divided value d1.

The divided value d1 is input from the latcher 74 to the 12-bit down-counter 75 and the 12-bit down-counter 75 counts down the divided value d1. The down-counter 75 is connected so that the reference pulse signal RS and the clock signal CK are input thereto. When the reference pulse signal RS is input, the down-counter 75 is reset. Whenever the clock pulse of the clock signal CK is input, the down-counter 75 counts down the clock pulse of the clock signal CK. When the countdown is completed, the down-counter 75 outputs a BORROW signal. That is, until the down-counter 75 is reset, the down-counter 75 repeats to output the BORROW signal. Therefore, the down-counter 75 outputs the BORROW signal as the internal timing signal TS in which the encoder cycle T is divided by "16". The internal timing signal TS becomes a pulse signal in which the cycle of the reference pulse signal RS (encoder cycle) is divided by "16".

Next, the first delay signal generator 62 will be described. The first delay signal generator 62 estimates a current encoder cycle by using two previous encoder cycles and generates the first delay signal DS1 by dividing the estimated current encoder cycle. Therefore, in order to estimate the encoder cycle, the arithmetic processing using the two previous encoder cycles is performed as one processing. This arithmetic processing is the same as the processing performed by the calculator 73 included in the internal timing signal generator 61.

The 16-bit latcher 81 latches the cyclic count value "b" of the up-counter 71 and is connected so that the reference pulse signal RS is input thereto. When the reference pulse signal is input, the latcher 81 is reset. At the same time, the latcher 81 latches the cyclic count value "b" of the up-counter 71.

The 16-bit latcher 82 latches the cyclic count value "b" of the latcher 81 and is connected so that the reference pulse signal RS is input thereto. When the reference pulse signal is input, the latcher 82 is reset. At the same time, the latcher 82 latches the cyclic count value "b" of the latcher 81 and the cyclic count value "a" of the latcher 82. Therefore, the latcher 82 maintains the cyclic count value "a" corresponding to the last but one previous encoder cycle TA.

The 16-bit calculator 83 inputs the cyclic count value "b" of the up-counter 81 and the cyclic count value "a" of the latcher 82 and calculates an output value "c" corresponding to the counter value of the current encoder cycle by using the both cyclic count values "a" and "b". The arithmetic expression is "c=[b−(a−b)]". The 16-bit calculator 83 has the same configuration as the 16-bit calculator 73 included in the internal timing signal generator 61.

The 5-bit latcher 84 is reset when the reference pulse signal RS is input. At same time, the 5-bit latcher 84 latches the output value "c" of the calculator 83. The 16-bit output value "c" is input from the calculator 83 to the latcher 84 and the latcher 84 latches only upper 5 bits of the output value "c". That is, while the upper 5 bits of the 16-bit output value "c" are latched by the latcher 84, the lower 11 bits are truncated. Therefore, the output value "c" is divided by "2048". That is, the latcher 84 serves as a divider and outputs a divided value d1 in which the output value "c" is divided by "16" and a divided value d2 in which the output value "c" is divided by "128".

The divided value d2 is input from the latcher 84 to the 5-bit down-counter 85, the 5-bit down-counter counts down the divided value d2. The down-counter 85 is connected so that the reference pulse signal RS and the clock signal CK are inputted thereto. When the reference pulse signal RS is input, the down-counter 85 is reset. Whenever the clock pulse of the clock signal CK is input, the down-counter 85 counts down the clock pulse of the clock signal CK. When the countdown is completed to have "0", the down-counter 85 outputs a BORROW signal. That is, until the down-counter 85 is reset, the down-counter 85 repeats to output the BORROW signal by counting down the divided value. Therefore, the down-counter 85 outputs the BORROW signal as a first delay signal DS1 in which the encoder cycle T is divided by "2048", that is, the internal timing signal TS is divided by "128".

The internal pulse counter 63 receives the internal timing signal TS and the reference pulse signal RS which are output whenever the down-counter 75 counts down the divided value d1. And then, the internal pulse counter 63 outputs a counting degree until counting "15" from counting the pulse of the internal timing signal TS and outputs a new internal timing signal TS by generating a pulse when receiving the pulse of the reference pulse signal RS. Further, when the internal pulse counter 63 is reset by receiving the pulse of the reference pulse signal RS, the internal pulse counter 63 outputs a first pulse of the internal timing signal TS of the next cycle. Therefore, the internal pulse counter 63 outputs 16 pulses of the internal timing signal TS within one cycle of the reference pulse signal RS. The internal timing signal TS is used as a reference signal to determine a print timing (ejection timing) for ejecting the ink droplets and is output to the delay counter 64 connected to the internal pulse counter 63

The delay counter 64 delays the internal timing signal (reference signal) by the delay time and outputs the delayed internal timing signal. The setting register 65 is connected to the delay counter 64. When the CPU 30 writes a delay setting value to the setting register 65, the delay count value (delay setting value) is set to the delay counter 64. When one of the first delay signal DS1 and the second delay signal DS2 is selected by the selector 68, the selected delay signal is input to the delay counter 64. When the acceleration/deceleration printing is performed, the first delay signal DS1 selected by the selector 68 is input to the delay counter 64. The delay counter 64 counts the number of the pulses of the input delay signal so as to count the delay count value. And then, the delay counter 64 outputs a preliminary timing signal PS to the output pulse controller 66 connected to the corresponding delay counter.

Further, the delay setting value is stored in the nonvolatile memory 34 with a firmware program. When the carriages moves to back and forth, the delay setting value is desirably set according to the difference of the printing velocity mode and difference of the velocity region including the constant velocity region and the accelerating/decelerating region.

The output pulse controller 66 serves to input the output pulse selecting signal and the preliminary timing signal PS. The output pulse controller 66 is connected to the head driver 40 so as to output the print timing signal PTS. When the output selecting signal is in a high level, the output pulse controller 66 outputs one print timing signal PTS for every pulse of the preliminary timing signal PS. When the output selecting signal is in a low level, the output pulse controller 66 outputs one print timing signal PTS for every two pulses of the preliminary timing signal PS. The print timing signal PTS is output to the head driver 40 connected to the output pulse controller 66.

The head driver 40 generates three kinds of ejecting pulses by using the internal driving signal generator, selects at least one of the three kinds of ejecting pulses according to the grayscale value on the basis of the input grayscale value data, and applies the selected ejecting pulse to a piezoelectric vibrators 70 according to a timing on the basis of the print timing signal PTS. As a result, the ejecting pulse (driving voltage) is applied to the piezoelectric vibrator corresponding to a nozzle for recording a pixel having a value other than the grayscale value data "00" among the piezoelectric vibrators 70. And then, the piezoelectric vibrator is vibrated according to the ejecting pulse waveform due to an electrostriction effect. Therefore, the ink chamber is expanded or compressed so that the ink droplets are ejected (jetted) from each nozzle. The grayscale value data indicates the grayscale value by, for example, two bits. For example, the grayscale value "00" indicates no ejection, the grayscale value "01" indicates that the dot size is small, the grayscale value "10" indicates that the dot size is middle, and the grayscale value "11" indicates that the dot size is large.

Further, the second delay signal generator 67 generates the second delay signal DS2 corresponding to the constant-velocity printing in which there is no difference between the previous encoder cycle and the current encoder cycle. For example, the second delay signal generator 67 has a configuration in which the latcher 82 and the calculator 83 are removed from the configuration of the first delay signal generator 62 so that the output value of the 16-bit latcher 81 (the cyclic count value "b") is input to the 5-bit latcher 84.

Figure 6:
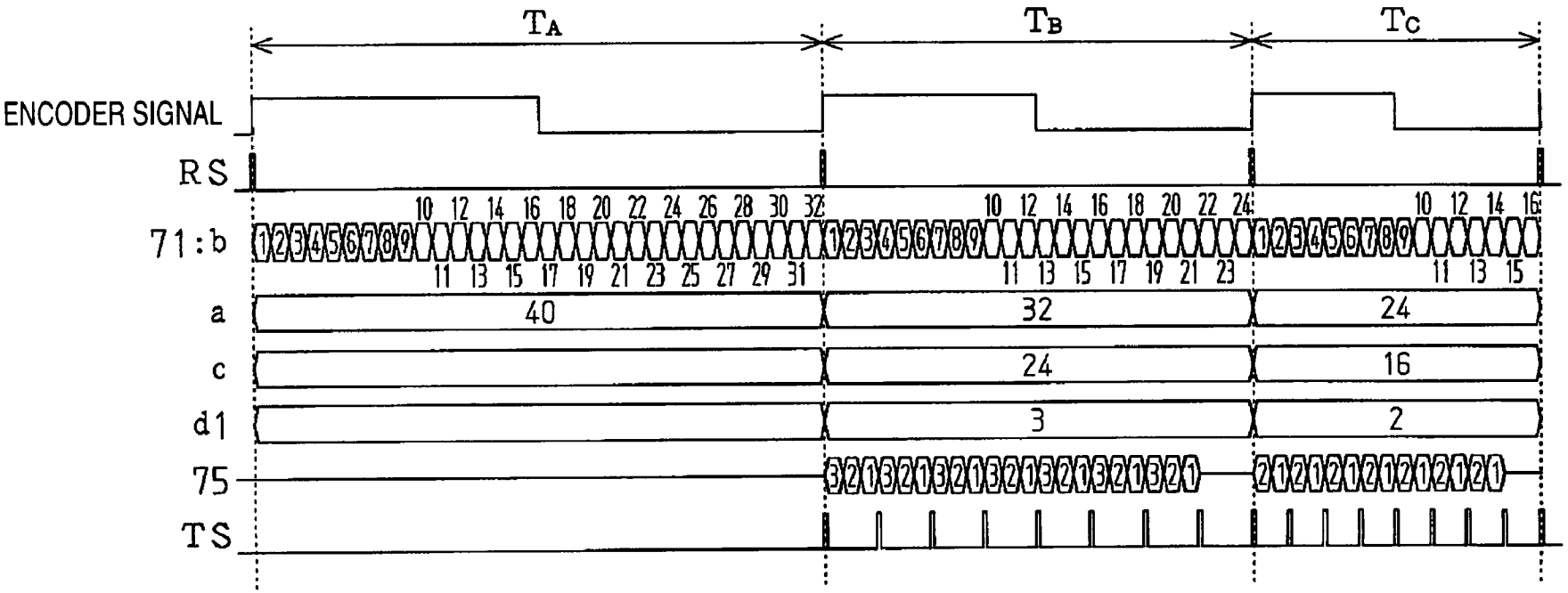
FIG. 6 is a timing chart showing generation of an internal timing signal shown in FIG. 5.

FIG. 6 is a timing flowchart showing a timing signal generating process in the accelerating region. However, in this figure, for convenience sake of the explanation, a count signal per an encoder cycle is expressed by a divided value "8" (corresponding to 13-bit latcher) not the divided value "16" by the 12-bit latcher.

For example, when the up-counter 71 counts the cyclic count value of the encoder cycle TA, the calculator 73 calculates an output value "c=[b−(a−b)] by using count value, that is, the previous information "b=32" and the last but one previous information "a=40" which is latched by the latcher 72. For example, in this calculation, the output value (calculated value) is expressed by "c=[32−(40−32)]=24". That is, the calculated value "24" is output from the calculator 73.

Next, lower 4 bits are truncated by the 12-bit latcher 74. In the example of FIG. 6, lower 3 bits are truncated and the latcher 74 latches value "3" in which the output value "c" of the calculator 73 is divided by "8". The down-counter 75 counts down the divided value "3" and outputs one pulse whenever completing the countdown. Therefore, the internal timing signal TS is generated so as to generate a pulse for every cycle in which the current encoder cycle TC (cyclic count value "24") is divided by "8".

The up-counter 71 counts the number, for example, double of the number divided by "8", per an encoder cycle. The up-counter 71 reads out values of the last but one previous information "80" and previous information "64", divides the output value "c=[b−(a−b)]=48" of the calculator 73 by "16" (16 division), and counts down the divided value "3" obtained in the 12-bit latcher 74 by using the down-counter 75.

Further, when the up-counter 71 completes to count the cyclic count value of the encoder cycle TB, the calculator 73 calculates output value "c=[b−(a−b)]" by using the previous information "b=24" calculated by the up-counter 71 and the last but one previous information a="32" latched by the latcher 72. The calculator 73 outputs a calculated value "16".

Next, the 12-bit latcher 74 truncates the lower 4 bits (lower 3 bits in the example of FIG. 6). Therefore, in an example of FIG. 6, the latcher 74 latches a value "2" in which the output value "c" of the calculator 73 is divided by "8". The down-counter 75 counts down the divided value "2" and outputs one pulse whenever completing the countdown. Therefore, the internal timing signal TS is generated so as to generate a pulse according to a cycle in which the current encoder cycle TC (cyclic count value "16") is divided by "8".

The up-counter 71 counts the number, for example, double of the number divided by "8", per an encoder cycle. The up-counter 71 reads out values of the last but one previous information "64" and previous information "48", divides the output value "c=[b−(a−b)]=32" of the calculator 73 by "16" (16 division), and counts down the divided value "2" obtained in the 12-bit latcher 74 by using the down-counter 75.

The down-counter 75 outputs the BORROW signal whenever counting down the divided value d1. The BORROW signal is output as the internal timing signal TS. The internal timing signal TS is used as the reference timing signal which determines a print timing (ejection timing) for ejecting the ink droplets and is output to the internal pulse counter 63.

The internal pulse counter 63 counts the pulse of the internal timing signal TS and outputs one pulse of the BORROW signal to the delay counter 64 at every counting until the counted value reaches "15". Further, the internal pulse counter 63 outputs 16 pulses which function as the internal timing signal TS (reference timing signal) within the encoder cycle T to the delay counter 64.

The delay counter 64 outputs the preliminary timing signal PS in which the delay time is elapsed from when the internal timing signal TS (reference timing signal) is input. The CPU 30 writes the delay setting value Dm into the setting register 65. The delay setting value Dm is stored in the nonvolatile memory 34 with a firmware program. When the carriage 12 moves to back and forth, the delay setting value is desirably set according to the difference of the printing mode (printing speed). The delay setting value Dm written in the setting register 65 is set by the delay counter 64. The delay counter 64 counts, for example, the input pulses of the first delay signal DS1 selected by the selector 68, from when the pulses of the internal timing signal TS (reference timing signal) are input. When the counted value reaches the delay setting value Dm, the delay counter 64 outputs one pulse of the preliminary timing signal PS to the output pulse controller 66.

The output pulse controller 66 outputs a print timing signal PTS that has one pulse per one pulse of the preliminary timing signal PS or one pulse per two pulses such that a prescribed resolution according to a printing mode is achieved on the basis of an output pulse selecting signal.

When the acceleration/deceleration printing is performed, if a pulse cycle of the first delay signal DS1 that is counted by the delay counter 64 has an approximate value according to the moving velocity of the carriage 12, delay time (delayed amount) that is determined by counting a delay setting value Dm is accurately set, which generates an accurate print timing signal PTS. In order to allow the pulse cycle of the first delay signal DS1 to have an approximate value according to carriage moving velocity, a divided value d2 that is set to the down-counter 85 needs to be an approximate value. For this reason, a current estimated period that is an output value "c" of the calculator 83 needs to be appropriately estimated.

Figure 7:
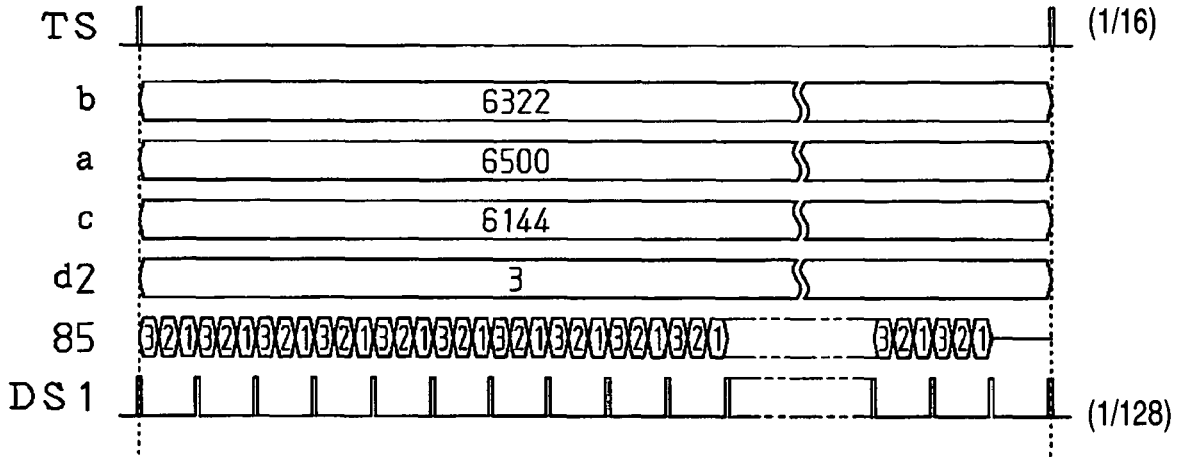
FIG. 7 is a timing chart showing generation of a first delay signal shown in FIG. 5

FIG. 7 is a timing chart related to the first delay signal generation performed in the first delay signal generator 62. In this figure, the cycle of the first delay signal being generated is short. For the easy comprehension of the explanation, it is exemplarily described that a count value for one encoder cycle is larger than the value shown in FIG. 6. In this figure, it is shown one cycle of the internal timing signal TS during the acceleration of the carriage 12, and a cycle dividing processing in which the one cycle of the internal timing signal TS is substantially divided into 128 segments is performed.

For example, when the up-counter 71 completes to count the cyclic count value of the encoder cycle TA, the calculator 83 calculates output value "c=[b−(a−b)]" by using the previous information "b=6322" stored in the latcher 81 which latches the cyclic count value and the last but one previous information "a=6500" latched by the latcher 82. For example, in this calculation, the output value (calculated value) "c=[6322−(6500−6322)]=6144". The calculator 83 outputs a calculated value "6144".

Next, the 5-bit latcher 84 truncates the lower 11 bits. Therefore, the latcher 84 latches a value "3" in which the output value of the calculator 83 "c=6144" is divided by "2048". The down-counter 85 counts down the divided value "3" and outputs one pulse whenever completing the countdown. Therefore, the first delay signal DS1 is generated so as to generate a pulse according to a cycle in which the current encoder cycle TB (cyclic count value "6144") is divided by "2048".

The internal timing signal TS and the first delay signal DS1 are generated by exactly estimating the current cycle and performing the cycle dividing processing with respect to the estimated cycle even in the accelerating/decelerating region. Therefore, the internal timing signal TS having high accuracy is output from the internal pulse counter 63 to the delay counter 64. Further, the first delay signal DS1 having high accuracy is input to the delay counter 64 through the selector 68. Whenever the pulse of the internal timing signal TS is input, the delay counter 64 is reset. The delay counter 64 counts the input pulse of the delay signal DS1 from when the delay counter 64 is reset. When the counted value reaches the delay setting value Dm, the delay counter 64 outputs the preliminary timing signal PS to the output pulse controller 66.

In accordance with the output pulse selecting signal, the output pulse controller 66 outputs the print timing signal PTS having one pulse for every one of the preliminary timing signal PS in a case where a high-resolution printing mode is selected, and having one pulse for two pulses of the preliminary timing signal PS in a case where a low-resolution printing mode is selected.

The head driver 40 generates three kinds of ejecting pulses by using the internal driving signal generator, selects at least one of the three kinds of ejecting pulses according to the grayscale value on the basis of the input grayscale value data, and applies the selected ejecting pulse to piezoelectric vibrators 70 according to a timing on the basis of the print timing signal PTS. As a result, at least one ejecting pulse (driving voltage) is applied to the piezoelectric vibrator corresponding to a nozzle forming a pixel having a value other than the grayscale value data "00" among the piezoelectric vibrators 70. Therefore, the ink droplets having a dot size according to the grayscale value are ejected (jetted) from the nozzle. When the carriage 12 moves back and forth, the carriage 12 moves from an original P0 to a stop position P5. In the range of positions P1 to P4 of the movement range, the acceleration printing, constant-velocity printing, and the deceleration printing are performed. An accurate printing is performed at a printing region based on the proper print timing signal PTS in which the delay time is properly determined for every movement range.

According to the above-described embodiment of the invention, the following advantageous effects can be attained.

(1) When the cycle is estimated, the count values "a" and "b" for the previous encoder cycle and the last but one previous encoder cycle are used. The current cyclic count value "c" is estimated by subtracting the previous cyclic count value "b" by the difference between the last but one previous cyclic count value "a" and the previous cyclic count value "b" (i.e., c=[b−(a−b)]), a cycle dividing process by the latcher 84 and a cycle diving process by the down-counter 85 that counts down the divided value are performed on the output value "c" that is the estimated cyclic count value, thereby generating a first delay signal DS1. It is possible to increase precision of the delay time determined by counting the delay setting value Dm on the basis of the pulse input time point of the internal timing signal TS. Therefore, the printing head 15 ejects ink droplets at an appropriate ejection timing of when the printing head 15 reaches an appropriate location according to the carriage velocity and a carriage moving direction. For this reason, it is possible to increase the printing precision of the printer 10. Further, since the internal timing signal TS and the first delay signal DS1 can be generated from a lower velocity region, it is possible to spread acceleration and deceleration regions.

(2) According to the related art, when the resolution of the first delay signal is fine and the encoder cycle T is divided by n (n division), if a change amount between the previous encoder cycle and the current encoder cycle is equal to or larger than 100/n (%), it is not possible to generate a prescribed number of pulses (n number) for the first delay signal. However, even when a change ratio between the previous encoder cycle and the current encoder cycle is equal to or larger than 100/n (%), the print timing generator 54 of this embodiment can generate a prescribed number of pulses (n pulses) for the first delay signal DS1. That is, in the related art, as the resolution becomes high, the allowable change ratio of the encoder cycle becomes small and the acceleration/deceleration printing can be performed only in the low accelerating/decelerating region. However, in this embodiment, even when the resolution of the first delay signal DS1 becomes high with respect to the encoder cycle T, since the prescribed number of pulses (n pulses) can be generated, the printing can be performed in the slow velocity region. In particular, even in a region where the velocity of the carriage is rapidly accelerated or decelerated, the printing can be performed. Therefore, for example, in order to spread a prescribed constant velocity region, even when the velocity of the carriage is controlled to be rapidly accelerated to the constant velocity Vc and rapidly decelerated from the constant velocity Vc, it is possible to perform the acceleration/deceleration printing and effectively and widely secure a printing allowable region. The above-described effect is the same with respect to the internal timing signal TS.

(3) The current cycle estimation arithmetic expression is a simple expression as output value "c=[b−(a−b)]" in which the difference between the last but one previous cyclic count value and the previous cyclic count value are subtracted from the previous cyclic count value. Therefore, the configuration of the calculators 73, 83 can be made simple and the calculation speed can substantially follow the carriage velocity.

(4) Since it is configured to operate the estimation cycle on the basis of a circuit included in hardware, it does not need to be processed by a CPU necessary in a case of using a method of setting a current estimation cycle or a current delay setting value on the basis of table data from the previous cycle (or velocity). Therefore, the workload for the CPU 30 can be reduced. Further, it is not necessary to secure a storage region for the table data in the memory such as the nonvolatile memory 34. Furthermore, in the case of the method of setting an estimation cycle or a delay setting value on the basis of table data, it can not be used when the velocity of the carriage 12 is changed. However, in the printer 10 of the embodiment, it is possible to correspond to the velocity change of the carriage 12 in a real time manner.

(5) With respect to the internal timing signal TS, the current estimated cycle is accurately estimated by performing a subtracting operation that subtracts the previous cyclic count value "b" by the difference between the previous cyclic count value and the last but one previous cyclic count value (a−b), and a cycle dividing processing that divides the accurate estimated cycle is performed, which generates an internal timing signal TS. Therefore, the precision of the internal timing signal TS that becomes a reference when determining an ink droplet ejection timing at which the ink droplet is ejected is increased. From the reference time point on the basis of the pulse input time point, the input pulse of the first delay signal DS1 is counted until the cycle reaches the delay setting value Dm, and the determined ejection timing by counting become an appropriate timing. As a result, even when the carriage 12 is in acceleration and deceleration regions, the ink droplet can be ejected with an appropriate ejection timing, which increases the printing precision.

(6) Since the pulse cycle of the first delay signal DS1 is shortly set to 1/128 of the pulse cycle of the internal timing signal TS, the delay setting value can be finely controlled. In addition, it is possible to precisely control the ejecting timing based on the print timing signal PTS.

(7) Since the print timing signal PTS is generated by using the same circuit in the acceleration and deceleration regions and the constant velocity region, it is possible to simplify the circuit structure of the print timing generating circuit 54.

(8) Since the first delay signal generator 62 and the second delay signal generator 67 are provided, it is possible to select a desired one for the printing mode from the first delay signal DS1 and the second delay signal DS2. For example, in a printing mode for the acceleration/deceleration printing, the first delay signal DS1 may be selected so as to increase the printing accuracy. In a printing mode for the constant velocity printing, the second delay signal DS2 may be selected so as to decrease a time needed to generate a delay signal. For example, in the constant-velocity printing, it is possible to perform a high-velocity printing by speeding up the carriage or make the printing dot have a high-resolution.

Next, a second embodiment according to the invention will be described. The second embodiment is different from the first embodiment in that the first delay signal is not corrected but the delay setting value is corrected.

Figure 8:
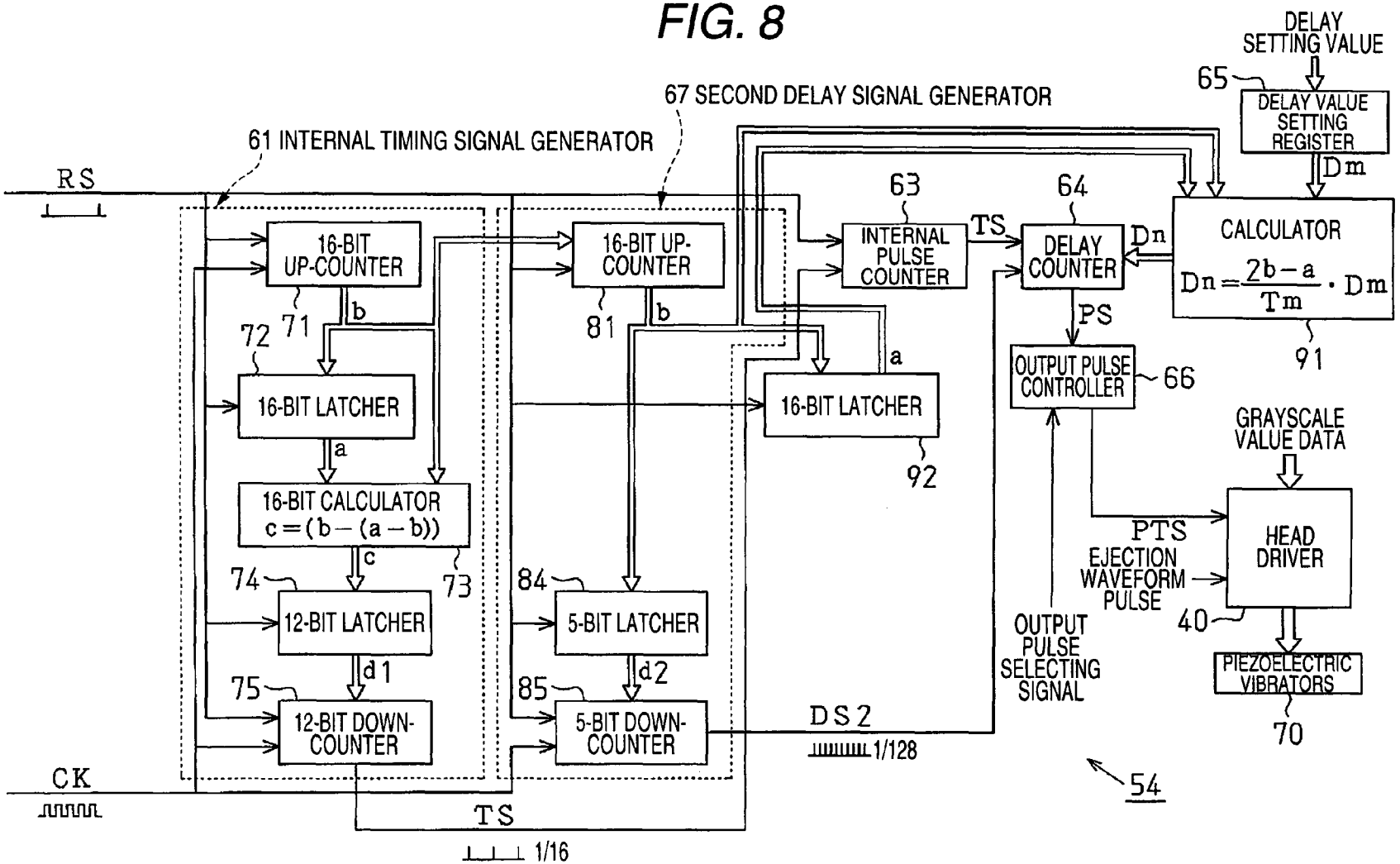
FIG. 8 is a block diagram showing a print timing generator according to a second embodiment of the invention.

As shown in FIG. 8, in the first delay signal generator 62 according to the first embodiment, the second delay signal DS2 in which the velocity change of the carriage 12 is not considered is input to the delay counter 64 instead of the second delay signal generator 67. That is, the second delay signal generator 67 generates the second delay signal DS2 by performing the division processing by the 5-bit latcher 84 and cycle dividing processing of counting down the divided value d2 by the down-counter 85 on the basis of the previous cyclic count value "b".

The delay setting value Dm written in the setting register 65 by the CPU is input to the delay counter 64 from the calculator 91 as a corrected delay setting value Dn in which a prescribed calculation is executed by the calculator 91. The calculator 91 executes a calculation on the basis of an arithmetic expression to which the velocity change of the carriage 12 is reflected. The calculator 91 corrects the delay setting value Dm so that a proper ejection timing is determined even though the delay counter 64 counts the number of pulses of the second delay signal DS2.

While the previous cyclic count value "b" is input to the calculator 91 from the latcher 81 of the second delay signal generator 67, the last but one previous cyclic count value "a" is input to the calculator 91 from the 16-bit latcher 92 which stores the value latched by the latcher 81 for one cycle. When the last but one previous cyclic count value "a" and the previous cyclic count value "b" are input to the calculator 91, the calculator 91 executes a calculation to obtain an output "Dn" on the basis of an arithmetic expression "Dn=[b−(a−b)]/Tm·Dm 32 [(2b−a)·Dm]/Tm". Here, "Tm" is a prescribed cycle of the reference pulse signal RS when the carriage 12 is in a prescribed velocity (in this embodiment, the constant velocity Vc shown in FIG. 3) and "Dm" is a delay setting value which is set by estimating a case when the carriage 12 is in the prescribed velocity (in this example, constant velocity Vc).

In this arithmetic expression, a current estimation cyclic count value (2b−a) is obtained by subtracting a difference value (a−b) between the last but one previous cyclic count value "a" and the previous cyclic count value "b" from the previous cyclic count value "b". And then, a ratio ((2b−a)/Tm) between the current estimation cyclic count value (2b−a) and an estimation set cyclic Tm which is a delay amount obtained by counting the delay setting value Dm is multiplied to the delay setting value Dm. In the output value (corrected delay setting value) Dn obtained by using the above-described arithmetic expression, the delay setting value Dm is corrected according to the velocity change of the carriage 12. In the constant velocity region of the carriage 12, since the last but one previous cyclic count value "a" becomes equal to the previous cyclic count value "b" (b=a), that is, the previous cyclic count value "b" becomes equal to the set cyclic Tm (Tm=b) which is a cyclic count value in a case of the constant velocity, the corrected delay setting value Dn becomes equal to Dm. Further, in the accelerating region of the carriage 12, the corrected delay setting value Dn is corrected to be equal to or larger than the delay setting value Dm (Dn≧Dm)

The delay counter 64 counts the number of pulses of the second delay signal DS. Further, when the counted value reaches the corrected delay setting value Dn, the delay counter 64 outputs the preliminary timing signal PS to the output pulse controller 66. For example, it is assumed that the delay setting value is a ¼ cycle of the internal timing signal TS and the delay setting value Dm is "32". If the last but one previous cyclic count value "a" is "32", the previous cyclic count value "b" is "24", and the set cycle Tm is "8", the corrected delay setting value Dn becomes "64". When the counted value of the delay counter 64 reaches "64", one pulse of the preliminary timing signal PS is output. The output pulse controller 66 outputs the print timing signal PTS having one pulse at every one pulse or two pulses of the preliminary timing signal PS so that the resolution can be corresponded to the printing mode on the basis of the output pulse selecting signal.

According to the configuration of this embodiment, the following advantageous effect can be obtained.

(9) In the print timing generator 54, the corrected delay setting value Dn in which the delay setting value Dm is corrected is set to correspond to the current estimation cycle to which the carriage velocity change (encoder cycle) is reflected. Therefore, it is possible to set a proper ejection timing even in the accelerating/decelerating region of the carriage 12 and it is possible to perform high accuracy printing.

Next, a third embodiment of the invention will be described. In this embodiment, the current encoder cycle (estimated encoder cycle) is calculated from the previous encoder cycle (or velocity) on the basis of the table data, and the calculated current encoder cycle is divided into sixteen segments so as to generate the internal timing signal as the second pulse signal. Further, the current encoder cycle (estimated encoder cycle) is divided so as to generate a delay signal as the third pulse signal. At this time, in the above-descried embodiments, the encoder cycle is divided into segments having the same length. However, in this embodiment, the encoder cycle is divided into segments having variable lengths according to the velocity variation in the accelerating and decelerating regions.

In the first and second embodiments, the case has been exemplified in which the velocity profile where the acceleration in the accelerating region and the deceleration in the decelerating region may be assumed as the approximately constant acceleration is adopted. On the assumption that the difference between the previous encoder cycle and the encoder cycle before the previous encoder cycle is equal to the difference between the previous encoder cycle and the current encoder cycle, the current encoder cycle is estimated. However, when the velocity profile is adopted where the variation in the acceleration is relatively large, it is difficult to accurately estimate the current encoder cycle by the methods in the respective embodiments. Accordingly, this embodiment adopts the configuration that acquires the measured current encoder cycle (estimated encoder cycle) by referring to the velocity profile data on the basis of the measured previous encoder cycle (measured cycle).

Figure 9:
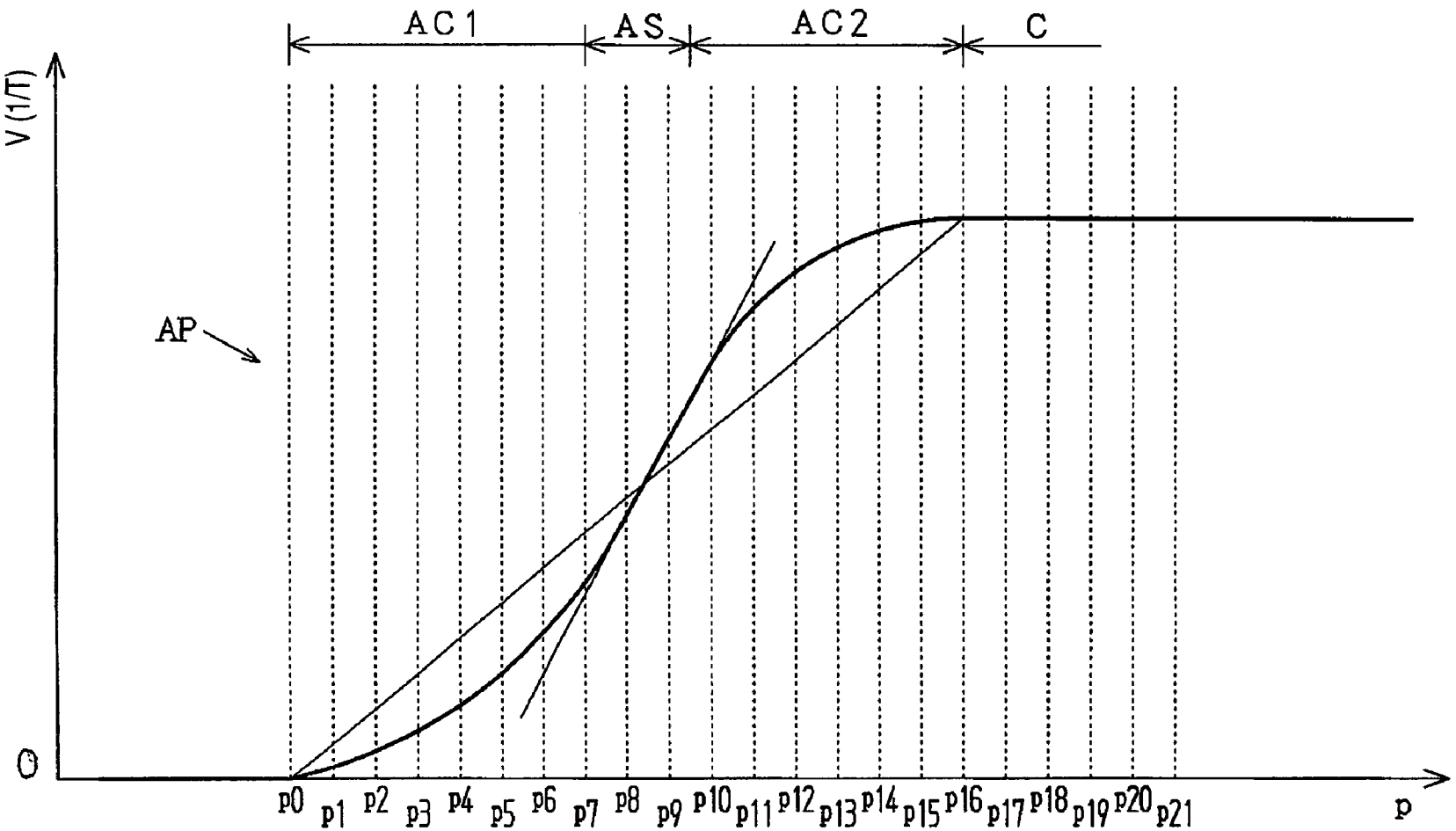
FIG. 9 is a graph showing a non-linear acceleration profile of the carriage.

In this embodiment, for example, the velocity profile shown by the graph of FIG. 9 is set. However, the velocity profile of FIG. 9 shows only portions of the accelerating region C and the constant velocity region, and the decelerating region is omitted. In the same graph, a horizontal axis indicates a position "p" of the carriage 12, and a vertical axis indicates the velocity V of the carriage 12. In the accelerating region of the velocity profile (acceleration interval from velocity 0 to constant velocity), an acceleration profile that draws the prescribed curve shown in FIG. 9 (hereinafter, referred to as non-linear acceleration profile AP) is set. In the non-linear acceleration profile AP, the acceleration printing region includes a non-linear accelerating region AC1 where the acceleration stepwise increases in an initial interval in the course of the acceleration, a non-linear accelerating region AC2 where the acceleration is stepwise decreased and reaches the constant velocity, and a linear approximating region AS between the non-linear accelerating regions AC1 and AC2 where the velocity is linearly increased at the constant acceleration. In this embodiment, at least the non-linear accelerating region AC2 is included in the acceleration printing region. Further, the decelerating region of the velocity profile also includes two non-linear regions where the deceleration is stepwise varied, similar to the accelerating region, and at least the initial non-linear decelerating region of when the velocity is decreased from the constant velocity region C is included in the deceleration printing region.

The velocity profile data may be composed of the table data in which the velocity V is associated with each position "p" of the carriage 12. In this embodiment, similar to the above-described embodiments, since the velocity control is performed by using the encoder cycle T that corresponds to an inverse number of the velocity V, the non-linear acceleration profile data is composed of the table data in which the encoder cycle T is associated with the position "p". The velocity profile data is stored in the ROM 32 or the nonvolatile memory 34, and thus a table 96 to be described below (shown in FIG. 10) is formed. For example, the non-linear acceleration profile data in the accelerating region shown in FIG. 9 is composed of the combination strings of the positions "p" and the encoder cycles T (table data), that is, the data strings of $(p_1, T_1), (p_2, T_2), \ldots, (p_n, T_n)$, and $(p_{n+1}, T_{n+1})$. In FIG. 9, the number of the position data in the accelerating region is represented by a small number, for convenience of description. However, in actual, a large amount of data is set.

Figure 10:
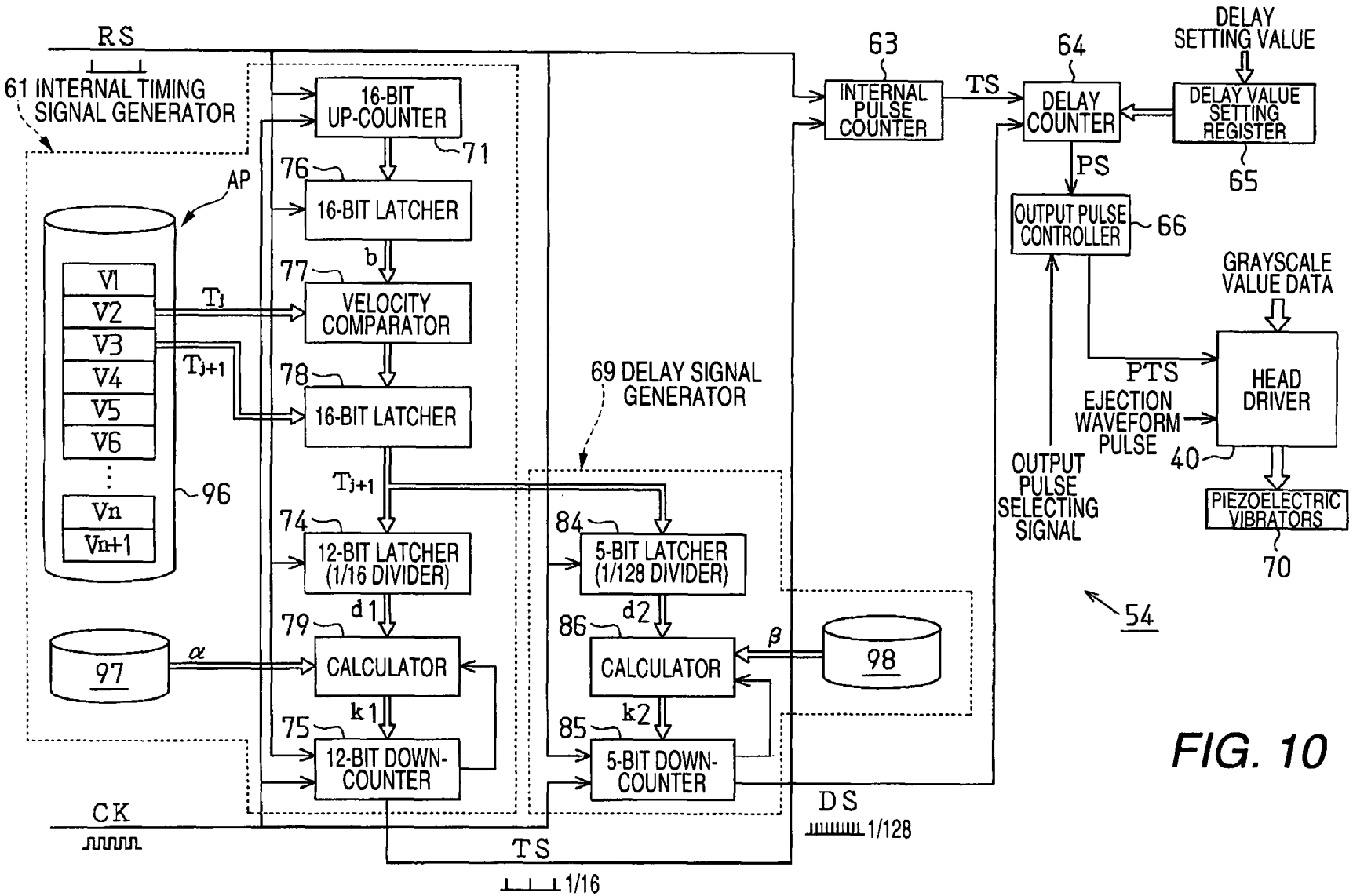
FIG. 10 is a block diagram showing a print timing generator according to a third embodiment of the invention.

FIG. 10 is a block diagram illustrating an inner structure of a print timing generator 54 in this embodiment. As shown in FIG. 10, the print timing generator 54 includes an internal timing signal generator 61, a delay signal generator 69, an internal pulse counter 63, a delay counter 64, a delay value set resister (hereinafter, referred to as "setting resister 65"), and an output pulse controller 66.

The internal timing signal generator 61 estimates the cycle of the reference pulse signal RS (encoder cycle T), and performs a cycle dividing processing that divides the estimated encoder cycle T into sixteen segments so as to generate the internal timing signal TS. The delay signal generator 69 performs a cycle dividing processing that divides the cycle of the estimated reference pulse signal RS (encoder cycle T), and generates delay signals DS that include pulse signals of segments obtained by dividing the cycle of the internal timing signal TS into the 128 segments. In the internal timing signal generator 61 and the delay signal generator 69, the current estimated encoder cycle (estimated encoder cycle) on which the cycle dividing processing is performed is obtained in a such a manner that the internal timing signal generator 61 refers to the table 96 on the basis of the measured previous encoder cycle. Since the table 96 is referred to, the current encoder cycle on the non-linear acceleration profile can be accurately estimated, and the internal timing signal TS and the delay signal DS can be generated with high precision.

In this case, the internal timing signal TS and the delay signal DS are obtained by performing a cycle dividing processing dividing the current encoder cycle by the cycle varying according to the velocity variation of the carriage 12 in the accelerating region or the decelerating region, and the cycle is continuously or stepwise varied according to the variation in the velocity. For example, in the accelerating region, the cycle of the internal timing signal TS becomes stepwise shorter as the velocity of the carriage is increased, and in the decelerating region, the cycle of the internal timing signal TS becomes stepwise longer as the carriage velocity is decreased. Further, for example, in the accelerating region, the cycle of the delay signal DS becomes stepwise shorter as the velocity of the carriage is increased, and in the decelerating region, the cycle of the delay signal DS becomes stepwise longer as the carriage velocity is decreased.

The internal timing signal generator 61 according to this embodiment includes a 16-bit up-counter 71, a 16-bit latcher 76, a velocity comparator 77, a 16-bit latcher 78, a 12-bit latcher 74, a 12-bit calculator 79, and a 12-bit down-counter 75. Further, the delay signal generator 69 includes a 5-bit latcher 84, a 5-bit calculator 86, and a 5-bit down-counter 85.

First, the internal timing signal generator 61 will be described. The internal timing signal generator 61 is a circuit that estimates the current encoder cycle through the table reference using the previous encoder cycle, and divides the estimated current encoder cycle into the segments having variable lengths according to the velocity variation of the carriage 12 so as to generate the internal timing signal.

The 16-bit up-counter 71 is connected such that the reference pulse signal RS and the clock signal CK are input, and counts the clock pulse of the clock signal CK. When the reference pulse signal RS is input to the 16-bit up-counter 71, it is reset. For this reason, the up-counter 71 outputs the cyclic count value "b" (cycle measuring value) that corresponds to the previous encoder cycle T. The up-counter 71 serves as a counter.

The 16-bit latcher 76 is a circuit that latches the cyclic count value "b" of the up-counter 71, and is connected such that the reference pulse signal RS is input to the 16-bit latcher 72. If the reference pulse signal RS is input to the 16-bit latcher 72, it is reset, and latches the cyclic count value "b" of the up-counter 71. For this reason, the cyclic count value "b" that corresponds to the previous encoder cycle TB is held in the latcher 76.

The velocity comparator 77 sequentially compares the previous cyclic count value "b" (encoder cycle) input from the latcher 76, and the velocities V1 to Vn on the velocity profile (in detail, encoder cycles T1 to Tn defining the velocities) that is set to the table 96 in a prescribed order, and searches the encoder cycle Tj (however, j=1, 2, . . . , and n+1) most similar to the cyclic count value "b" (encoder cycle). In addition, a next position pj+1 of the position pj that corresponds to the searched encoder cycle Tj most similar to the cyclic count value "b" is output to the latcher 78.

The latcher 78 reads the velocity vj+1 (specifically, encoder cycle Tj+1) corresponding to the input position pj+1 from the table 96 and latches it. The velocity comparator 77 may have a structure in which the velocity comparator 77 acquires the next velocity Vj+1 (encoder cycle Tj+1) to be designated after the velocity Vj in most close proximity, and outputs the next velocity Vj+1 (encoder cycle Tj+1) to the latcher 78 so as to be latched by the latcher. The encoder cycle Tj+1 that is latched by the latcher 78 is output to both the latcher 74, and the latcher 84 in the delay signal generator 69.

If the reference pulse signal RS is input to the 12-bit latcher 74, the 12-bit latcher 74 is reset, and latches the encoder cycle Tj+1 that is an output value of the latcher 78 at this time. The latcher 74 is a circuit that receives the output value Tj+1 of 16 bits from the latcher 78, and latches only 12 high-order bits of the output value Tj+1. That is, the latcher 74 latches only 12 high-order bits from the output value Tj+1 of 16 bits, and 4 lower-order bits are truncated. As a result, the output value Tj+1 is divided by "16". That is, the latcher 74 serves as a divider, and outputs a divided value d1.

On the basis of a table 97, the calculator 79 acquires a correction ratio α to correct the input divided value d1 according to the carriage velocity variation in the accelerating region or the decelerating region. In the table 97, a plurality of correction ratios α (for example, α1, α2, . . . , and αn) that correspond to the divided value d1 are set. The correction ratios α1, α2, . . . , and αn are stepwise decreased in the course of the acceleration, and are stepwise increased in the course of the deceleration. The calculator 79 is connected such that the calculator 79 receives a BORROW signal from the counter 75. Whenever the calculator 79 receives the BORROW signal, the calculator 79 acquires the correction ratio αj corresponding to the divided value d1 on the basis of the table 97, and outputs a corrected divided value k1 (=αj·d1) having corrected the divided value d1 to the counter 75. Alternatively, when the same correction ratio αj is continuous several times, the number of times of the BORROW signal that is received after outputting the first corrected divided value k1 is counted by a counter (not shown). If the count value reaches the prescribed number of times set to the correction ratio αj at this time, the corresponding correction ratio αj may be changed to the next correction ratio αj+1, and the corrected divided value k1 may be switched into the next value.

The 12-bit down-counter 75 is a circuit that performs countdown on the corrected divided value k1 received from the calculator 79. The down-counter 75 is connected such that the reference pulse signal RS and the clock signal CK are input. If the reference pulse signal RS is input to the down-counter 75, it is reset. Whenever the clock pulse of the clock signal CK is input to the down-counter 75, the down-counter 75 performs countdown, and whenever the countdown is completed, the down-counter 75 outputs the BORROW signal. That is, during a cycle until the down-counter 75 is reset, the down-counter 75 performs countdown of the corrected divided value k1 that is changed whenever the countdown is completed, or the correction dividing k1 that is changed whenever the countdown is completed by a prescribed times, and outputs the BORROW signal. The down-counter repeats this processing, and outputs the BORROW signal as the internal timing signal TS that divides the encoder cycle T into sixteen segments. Therefore, the cycle of each pulse of the generated internal timing signal TS is changed whenever the corrected divided value k1 is changed, and stepwise varies according to the velocity variation in the accelerating and decelerating regions. For example, in the internal timing signal TS, the cycle of each pulse signal is stepwise shortened in the accelerating region each time. Alternatively, after the same cycle is continuous several times, the corresponding cycle is changed to the further short cycle, and after the further short cycle is continuous several times, the corresponding cycle may be changed to the still further short cycle. This process is repeated, and the cycle is stepwise shortened. In contrast as that in the accelerating region, in the decelerating region, the cycle of the internal timing signal TS is stepwise lengthened each time or several times.

Next, the delay signal generator 69 will be described. The delay signal generator 69 is a circuit that divides the current estimated encoder cycle Tj+1 latched by the latcher 78, and generates the delay signal DS.

If the reference pulse signal RS is input to the 5-bit latcher 84, it is reset. The 5-bit latcher 84 is a circuit that receives the output value Tj+1 of 16 bits from the latcher 78, and latches only 5 higher bits of the output value Tj+1. That is, the latcher 84 latches only 5 higher bits of the output value Tj+1 of 16 bits, and 11 lower bits are truncated. As a result, the output value Tj+1 is divided by "2048". That is, the latcher 84 serves as a divider, and outputs a divided value d2 that is obtained by dividing the output value Tj+1 by "2048". The divided value d2 is equal to a value that is obtained by dividing the divided value d1, which is obtained by dividing the output value Tj+1 by "16", by "128" again.

On the basis of a table 98, the calculator 86 acquires a correction ratio β to correct the input divided value d2 according to the velocity variation. In the table 98, a plurality of correction ratios β (for example, β1, β2, . . . , and βn) that correspond to the divided value d2 are set. The correction ratios β1, β2, . . . , and βn are stepwise decreased in the course of the acceleration, and are stepwise increased in the course of the deceleration. The calculator 86 is connected such that the calculator 86 receives a BORROW signal from the counter 85. Whenever the calculator 86 receives the BORROW signal, the calculator 86 acquires the correction ratio βj corresponding to the divided value d2 at this time on the basis of the table 98, and outputs a corrected divided value k2 (=βj·d2) obtained by correcting the divided value d2 to the counter 85. Alternatively, when the same correction ratio βj is continuous several times, the number of times of the BORROW signal that is received after outputting the first corrected divided value k2 is counted by a counter (not shown). If the count value reaches the prescribed number of times acquired from the table 98, the corresponding correction ratio βj may be changed to the next correction ratio βj+1, and the corrected divided value k2 may be changed to the next value.

The 5-bit down-counter 85 is a circuit that performs countdown of the corrected divided value k2 received from the calculator 86. The down-counter 85 is connected such that the reference pulse signal RS and the clock signal CK are input. If the reference pulse signal RS is input to the down-counter 85, it is reset. Whenever the clock pulse of the clock signal CK is input to the down-counter 85, it performs countdown, and whenever the countdown is completed and the count value becomes "0", the down-counter 85 outputs the BORROW signal. That is, during a cycle until the down-counter is reset, the down-counter down-counts the corrected divided value k2 that is changed whenever the countdown is completed, or the corrected divided value k2 that is changed whenever the countdown is completed by a prescribed times, and outputs the BORROW signal. The down-counter repeats this process, and outputs the BORROW signal as the delay signal DS that divides the encoder cycle T by "2048", that is, divides the internal timing signal TS by "128". Therefore, the cycle of the delay signal DS stepwise varies according to the velocity variation in the accelerating and decelerating regions.

Each of the internal pulse counter 63, the delay counter 64, the setting register 65, and the output pulse controller 66 has the same structure as the first embodiment. The CPU 30 writes the delay setting value in the setting register 65, and thus the delay count value (delay setting value) is set to the delay counter 64. If the delay counter 64 counts the pulse of the input delay signal DS and completely counts the delay count value, the delay counter 64 outputs the preliminary timing signal PS to the output pulse controller 66 that is connected to the delay counter 64.

In this embodiment, the cycle of the internal timing signal TS that becomes a reference to determine the pulse output time point of the preliminary timing signal PS is stepwise varied according to the velocity variation in the accelerating and decelerating regions, and the interval at which the pulse of the internal timing signal TS is input to the delay counter 64 is stepwise varied according to the velocity variation. Since the pulse output time point of the internal timing signal TS that becomes the reference to determine the output time point of the preliminary timing signal PS is corrected as the velocity variation in the accelerating and decelerating regions are reflected, the precision of the preliminary timing signal PS that is output from the delay counter 64 becomes high because the velocity variation in the accelerating and decelerating regions is reflected. Further, in this embodiment, the cycle of the delay signal DS that determines the delay time with respect to the pulse output time point of the internal timing signal TS is also stepwise varied according to the velocity variation in the accelerating and decelerating regions, and the intervals at which the pulse of the delay signal DS is input to the delay counter 64 is stepwise varied according to the velocity variation. For this reason, since the delay time with respect to the internal timing signal TS is corrected as the velocity variation in the accelerating and decelerating regions are reflected, the precision of the preliminary timing signal PS that is output from the delay counter 64 is high because the velocity variation in the accelerating and decelerating regions is reflected. Therefore, the print timing signal PTS that is output to the printing head driver 40 from the output pulse controller 66 is generated on the basis of the internal timing signal TS and the delay signal DS whose pulse output time points are corrected according to the velocity variation in the accelerating and decelerating regions, which increases precision of the pulse output time point in the accelerating and decelerating regions.

Figure 11A:
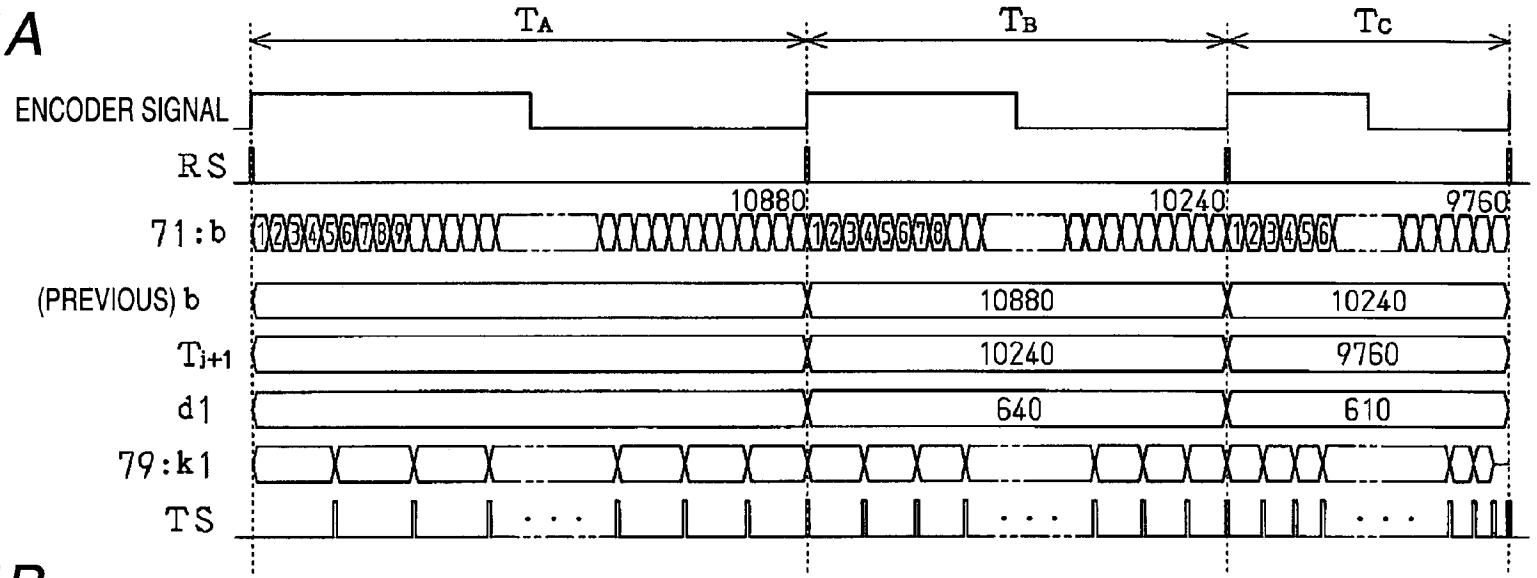
FIG. 11A is a timing chart showing generation of an internal timing signal shown in FIG. 10.

FIG. 11A is a timing chart illustrating the generation of the internal timing signal TS in the accelerating region, which shows a schematic diagram illustrating a state where the data output time from the calculator 79, and a cycle of the internal timing signal TS for each encoder cycle are not accurately shown in order to be easily recognized.

For example, when the up-counter 71 completely counts the cyclic count value "10880" of the encoder cycle TA, the 16-bit latcher 76 latches the previous cyclic count value corresponding to the count value (b="10880"). In addition, the velocity comparing unit 77 sequentially compares the latched previous cyclic count value "b" and the velocities V1 to Vn in the table 96 (specifically, encoder cycles T1 to Tn) in a prescribed order, and searches the encoder cycle Tj (j=1, 2, . . . , and n+1) that is most similar to the cyclic count value "b" (encoder cycle). The 16-bit latcher 78 latches the current encoder cycle Tj+1 to be designated after the encoder cycle Tj searched by the velocity comparator 77. The encoder cycle Tj+1 that is latched by the latcher 78 is output to the 12-bit latcher 74.

Next, the lower 4 bits are truncated by the 12-bit latcher 74, and the latcher 74 latches the divided value d1 that is obtained by dividing the next encoder cycle Tj+1 to be the output value of the latcher 78 by "16". For example, as shown in FIG. 11A, when the current estimated encoder cycle Tj+1 is "10240", the divided value "d1=640" that is obtained by dividing the "10240" by "16" is output from the 16-bit latcher 78. Whenever the 12-bit calculator 79 receives the BORROW signal from the counter 75, the calculator 79 acquires a correction ratio $\alpha$ corresponding to the divided value d1 at this time on the basis of the table 97, calculates the next corrected divided value k1 ($=\alpha j \cdot d1$), and outputs the corrected divided value k1 to the counter 75. Alternatively, when the same corrected divided value k1 is continuous several times, the number of times of the BORROW signal that is received after outputting the first corrected divided value k1 may be counted by a counter (not shown). If the count value reaches the prescribed number of times, the corresponding output value may be changed to the next corrected divided value k1 ($=\alpha j \cdot d1$). The down-counter 75 counts down the corrected divided value k1 received from the calculator 79, and outputs one pulse whenever the countdown is completed. In this way, the internal timing signal TS is generated in which the current encoding cycle TC (cyclic count value "10240") is divided into 16 by the cycle varying according to the velocity variation in the accelerating region.

Figure 11B:
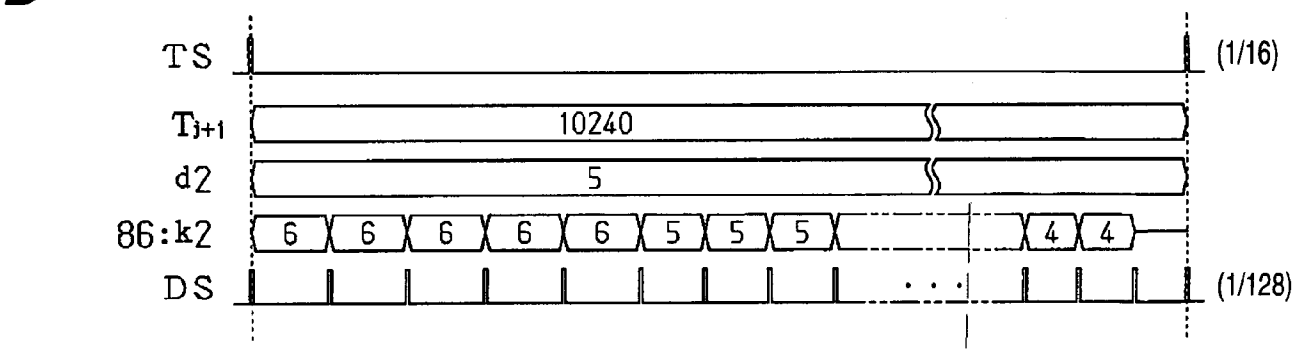
FIG. 11B is a timing chart showing generation of a delay signal shown in FIG. 10.

Meanwhile, as shown in FIG. 11B, in the delay signal generator 69, the cycle dividing processing is performed for dividing one cycle of the internal timing signal TS into 128 segments and generating the delay signal DS. The current estimated encoder cycle Tj+1 of 16 bits is input to the 5-bit latcher 84 that forms the delay signal generator 69 from the 16-bit latcher 78. In the 5-bit latcher 84, 11 lower bits are truncated from the input estimated encoder cycle Tj+1 of 16 bits. As a result, the latcher 84 latches the divided value "d2=5" that is obtained by dividing the estimated encoder cycle Tj+1="10240" by "2048".

Whenever the 5-bit calculator 86 receives the BORROW signal from the counter 85, the calculator 86 acquires the correction ratio $\beta j$ corresponding to the divided value d2 at that time on the basis of the table 98 so as to calculate the next corrected divided value k2 ($=\beta j \cdot d2$), and outputs a corrected divided value k2 to the counter 85. Alternatively, when the same corrected divided value k2 is continuous several times, the number of times of the BORROW signal that is received after outputting the first corrected divided value k2 may be is counted by a counter (not shown). If the count value reaches the prescribed number of times, the output value may be changed to the next corrected divided value k2 ($=\beta j \cdot d2$).

The down-counter 85 counts down the corrected divided value k2, and outputs one pulse whenever the countdown is completed. In this way, the delay signal DS is generated in which the current encoding cycle TB (cyclic count value "10240") is divided into 2048 segments having variable lengths according to the velocity variation in the accelerating region, that is, the cycle of the internal timing signal is divided into 128 segments having variable lengths according to the velocity variation. Further, each data of the corrected divided values k1 and k2 of the tables 97 and 98 is set such that the total sum of the cycle of each pulse of the delay signal DS output from the down-counter 85 in one cycle of the internal timing signal TS is matched with the cycle of the internal timing signal TS at that time.

As such, even in the accelerating region, the current encoder cycle is estimated with high precision, and a cycle dividing processing is performed on the estimated encoder cycle, which generates the internal timing signal TS and the delay signal DS. Therefore, the internal timing signal TS with high precision is input to the delay counter 64 from the internal pulse counter 63, and the delay signal DS with high precision is input to the delay counter 64 from the down-counter 85 whenever the pulse of the internal timing signal TS is input to the delay counter 64, the delay counter 64 is reset, and counts the input pulse of the delay signal DS at the time of being reset. When the count value reaches the delay setting value Dm, the delay counter 64 outputs the preliminary timing signal PS to the output pulse controller 66. Accordingly, from the output pulse controller 66, the print timing signal PTS that is synchronized with the preliminary timing signal PS and has high precision is output.

As described above, according to this embodiment, the following advantageous effects can be attained.

(10) The velocity comparator 77 may have a structure in which the velocity comparator 77 calculates the previous velocity (previous encoder cycle) on the non-linear acceleration profile by referring to the table 96 on the basis of the measured previous encoder cycle Tj, and acquires the current velocity (current estimated encoder cycle Tj+1) to be designated after the calculated previous velocity from the table 96. Accordingly, even when the non-linear acceleration profile is set in which the velocity variation in the accelerating and decelerating regions is large and the acceleration is not substantially constant, it is possible to accurately estimate the current encoder cycle Tj+1. As a result, it is possible to generate the internal timing signal TS that has the appropriate cycle according to the velocity variation in the non-linear accelerating region and has high precision. Therefore, even when the non-linear acceleration profile is set, it is possible to ensure the high printing precision in the accelerating and decelerating regions.

(11) The calculator 79 is so configured as to correct the divided value d1 input from the latcher 74 to the corrected divided value k1 according to the velocity variation on the basis of the table 97. Therefore, since the counter 75 obtains 16 divided-segments having variable lengths on the basis of the corrected divided value k1 so as to generate the internal timing signal TS, the pulse output time point may depend on the velocity variation. As a result, it is possible to further increase the printing precision in the accelerating and decelerating regions.

(12) The calculator 86 is so configured as to correct the divided value d2 input from the latcher 84 to the corrected divided value k2 according to the velocity variation on the basis of the table 98. Therefore, since the counter 85 obtains 2048 divided-segments having variable lengths on the basis of the corrected divided value k2 so as to generate the delay signal DS, the pulse output time point may depend on the velocity variation. As a result, it is possible to further increase the printing precision in the accelerating and decelerating regions.

Next, a fourth embodiment of the invention will be described. The fourth embodiment corresponds to a modification of the third embodiment. In the forth embodiment, the delay setting value Dm is corrected using the current estimated encoder cycle Tj+1 that is obtained referring to the data table of the velocity profile on the basis of the previous encoder cycle (or velocity).

Figure 12:
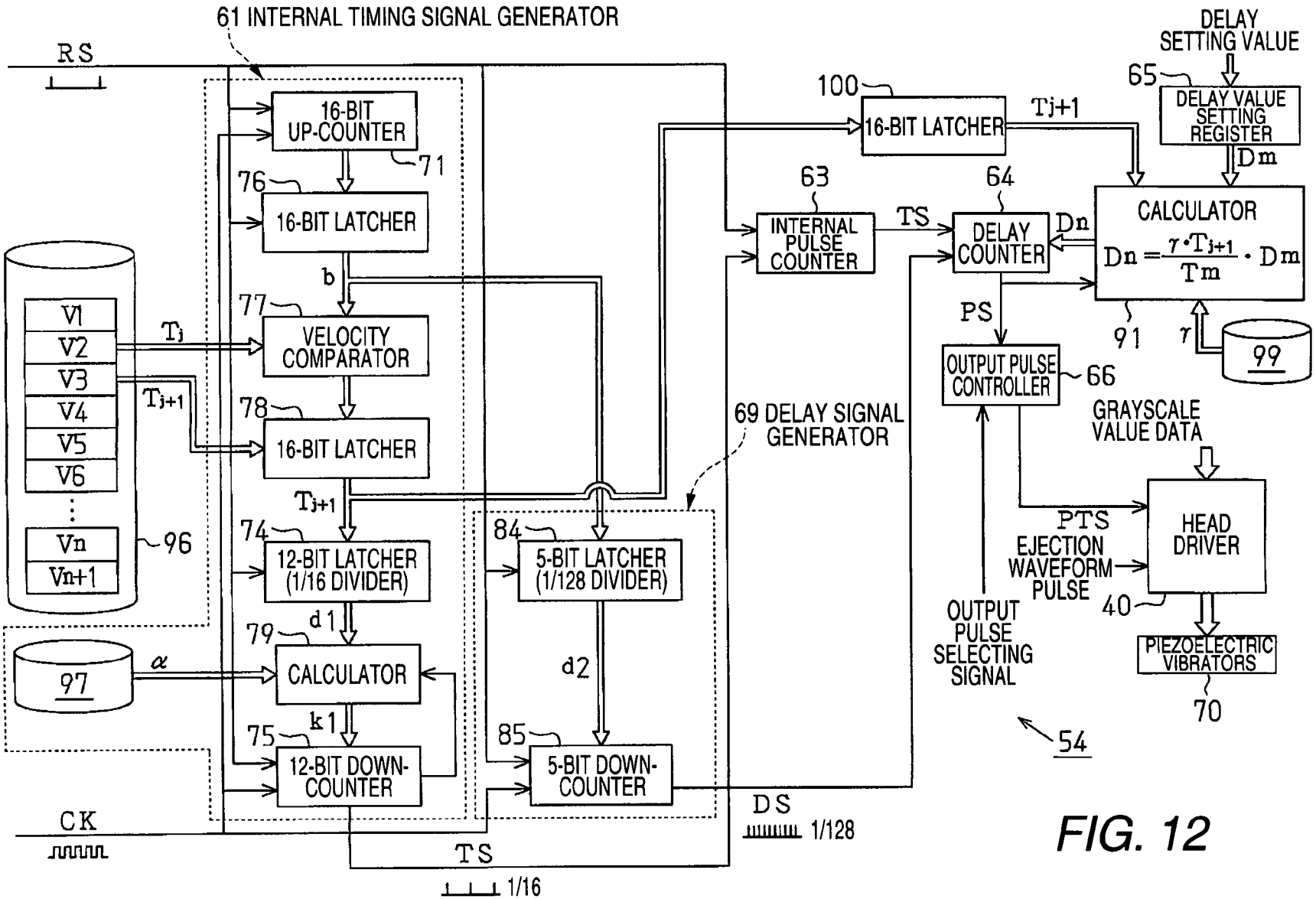
FIG. 12 is a block diagram showing a print timing generator according to a fourth embodiment of the invention.

As shown in FIG. 12, the internal timing signal generator 61 is the same as that of the third embodiment. The delay signal generator 69 does not include the calculator 86 and the table 98 used in the third embodiment, but includes the 5-bit latcher 84 and the 5-bit down-counter 85. The cycle correction according to the velocity variation is not performed on the delay signal DS, but similar to the second embodiment, the delay setting value is corrected. For this reason, a calculator 91 is provided which corrects the delay setting value Dm input from the setting register 65. Different from the second embodiment, the calculator 91 according to this embodiment acquires the estimated encoder cycle Tj+1 obtained by referring to the table 96, acquires the correction ratio γ corresponding to the estimated encoder cycle Tj+1 obtained by referring to a table 99, performs a calculation that corrects the delay setting value Dm using the acquired values Tj+1 and γ, and acquires the corrected delay setting value Dn. For this reason, in the table 99, the correction ratios γ (for example, γ1, γ2, . . . , and γn) corresponding to the estimated encoder cycle Tj+1 are stored as the table data.

That is, in the non-linear acceleration profile, among one cycle of the encoder cycle, the carriage velocity is changed, the correction is performed by the calculator 79 in order to generate the internal timing signal TS1 of the variable cycle according to the velocity variation. Meanwhile, even when acquiring the estimated encoder cycle Tj+1 that is accurately estimated from the non-linear acceleration profile, in this embodiment, since the delay signals DS are signals of constant cycles obtained by dividing the estimated encoder cycle Tj+1 into the same segments, the delay setting value Dm is corrected. For example, using the correction method according to the second embodiment, a value that is represented by "Tj+1·Dm/Tm" is set to the delay setting value, and the pulse of the delay signal DS of a constant cycle is counted. When the count value reaches the delay setting value, the delay counter 64 generates the internal timing signal TS. In this case, although the plurality of internal timing signals TS are not synchronized with one another, the delay time is the same, and the delay time does not become a prescribed ratio according to the cycle of the internal timing signal TS. Accordingly, during the current encoder cycle Tj+1, even though the cycle of the internal timing signal TS during which the 16 pulse output is made is varied according to the velocity variation, this embodiment acquires the corrected delay setting value Dn that has corrected the delay setting value Dm to become the prescribed ratio with respect to the cycle at the respective time points.

The calculator 91 is connected such that the calculator 91 receives the estimated encoder cycle Tj+1 that is output from the 16-bit latcher 78 and is output again after being latched by a 16-bit latcher 100. Further, the calculator 91 is connected such that the calculator 91 receives the preliminary timing signal PS output from the delay counter 64. If the calculator 91 receives the preliminary timing signal PS, the calculator 91 acquires the correction ratio γ that corrects the delay setting value Dm by referring to the table 99 on the basis of the estimated encoder cycle Tj+1 from the latcher 100. In addition, the calculator 91 operates the corrected delay setting value Dn using an equation "Dn=γ·Tj+1·Dm/Tm", and outputs the operated corrected delay setting value Dn to the delay counter 64. Whenever the calculator 91 receives the preliminary timing signal PS from the delay counter 64, the calculator 91 performs an operation that calculates the corrected delay setting value Dn. In this case, the correction rations γ are composed of a plurality of data strings (for example, γ1, γ2, . . . , and γn), and with respect to each of the correction ratios γ1, γ2, . . . , and γn, the number of times of when each correction ratio is used is set. In the calculator 91, the internal counter counts the number of times of when the preliminary timing signal PS is input. If the count value reaches the number of times Nj that corresponds to the correction ratio γj, the calculator 91 acquires the next correction ratio γj+1 corresponding to the estimated encoder cycle Tj+1 at that time from the table 99. The sixteen correction ratios γ (the number of the correction ratios is the same at the number of pulses of the internal timing signal TS) that correspond to the encoder cycle Tj+1 are prepared, and when the preliminary timing signal PS is input, the delay setting value Dm may be corrected each time.

The present embodiment uses the structure that corrects the delay setting value Dm according to the variable cycle of the internal timing signal TS. In this embodiment, it is possible to achieve the same effect as the third embodiment.

Next, a fifth embodiment of the invention will be described. In the second embodiment, the delay signal is generated as the count pulse signal. In this embodiment, the circuit which generates the delay signal is omitted. For example, as shown in FIG. 13, the second delay signal generator 67 is omitted. Instead of the second delay signal generator 67, a latcher 94 which outputs the previous cyclic count value "b" to the calculator 91 and a latcher 95 which outputs the last but one previous cyclic count value "a" to the calculator 91 are provided. Further, the clock signal CK is input to the delay counter 64 as the count pulse signal. The delay setting value Dm written to the setting register 65 by the CPU 30 is as follows. For example, if the cycle of the reference pulse signal RS is 2 msec and the cycle of the clock signal CK is 20 μsec, 100 pulses of the clock signal CK exist per a cycle of the internal timing signal TS. For example, if the delay time is, for example, ¼ cycle of the internal timing signal TS, the delay setting value becomes "25". As like this, when the clock signal CK is input, a proper value corresponding to the cycle (or frequency) of count pulses input to the delay counter 64 is set to the delay setting value. For example, it is assumed that the delay setting value is "25". When the last but one previous cyclic count value "a" is "32", the previous cyclic count value "b" is "24", and the set cycle Tm is "8", the corrected delay setting value Dn becomes "50". The delay counter 64 counts the pulses of the clock signal CK being input. When the counted value reaches the corrected delay setting value Dn="50", the delay counter 64 outputs one pulse of the preliminary timing signal PS.

With this configuration, since the counter performs a counting operation utilizing (diverting) the clock signal (clock pulse) generated by the clock generator 43 until the value reaches the corrected delay setting value Dn, it is not necessary to provide a dedicated circuit that generates the counting pulse signal. Further, since the clock pulse generally a high frequency as compared with the output frequency of the encoder or the like, it is possible to set the delay time with high precision.

Figure 14:
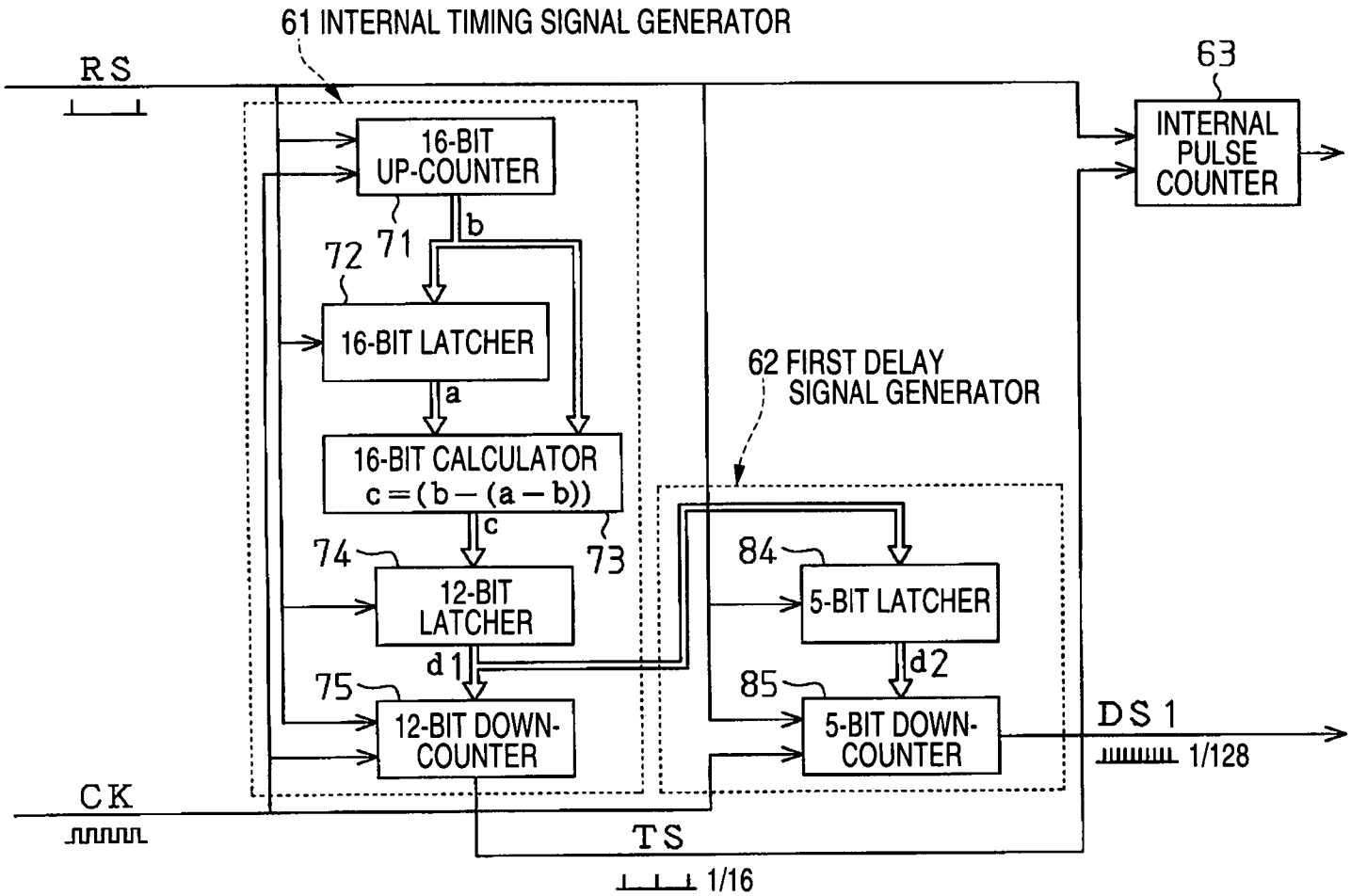
FIG. 14 is a block diagram showing a print timing generator according to a sixth embodiment of the invention.
Figure 15A:
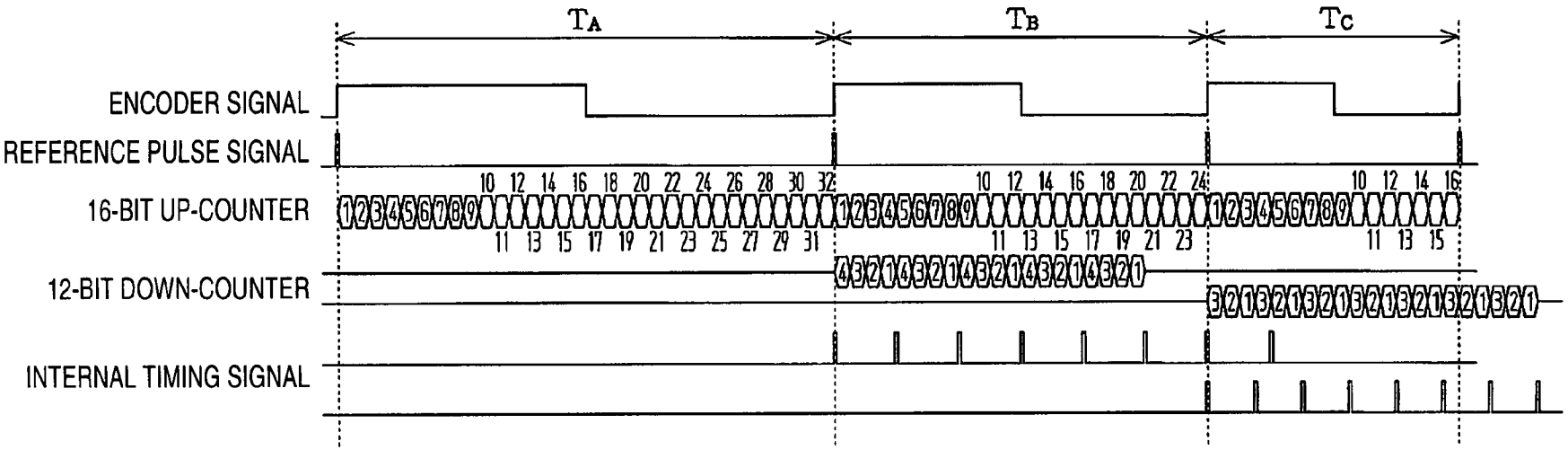
FIGS. 15A and 15B are timing charts showing generation of an internal timing signal in a related art.
Figure 15B:
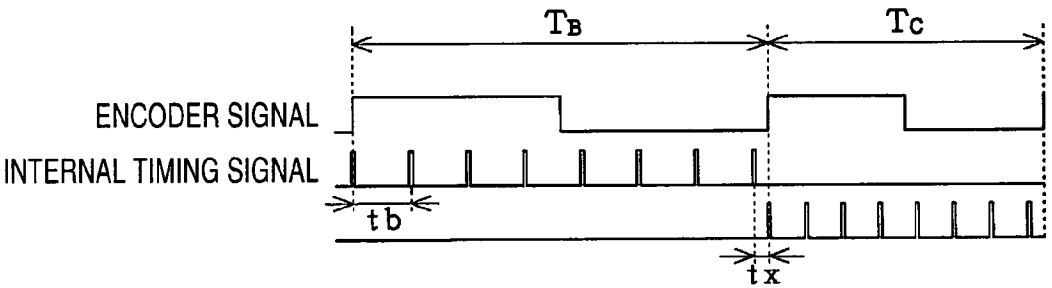

Next, a sixth embodiment of the invention will be described. In the first embodiment, the first delay signal generator 62 includes the latcher 81, the latcher 82, and the calculator 83. However, these may be omitted. As shown in FIG. 14, a first delay signal generator 62 includes a 5-bit latcher 84 to which a divided value d1 is input from a latcher 74 of an internal timing signal generator 61 and a 5-bit down-counter 85 which counts down a divided value d2 input from the latcher 84. The lower 7 bits are truncated from the 12-bit divided value d1 by the 5-bit latcher 84. Therefore, since the upper 5 bits are latched, the latcher 84 outputs the divided value d2 in which the divided value d1 is divided by "128". Further, the down-counter 85 generates the internal signal TS by outputting one pulse whenever counting down the divided value d2.

With this configuration, since the latcher 72 and the calculator 73 serving as an estimator are shared by the internal timing signal generator 61 and the fist delay signal generator 62, it is possible to simplify the circuit structure of the print timing generator 54.

In the first and second embodiments, the calculation formula is used in which the difference between the previous encoder cycle Tn−1 and the last but one previous encoder cycle Tn−2 is assumed as the difference between the previous encoder cycle Tn−1 and the current encoder cycle Tn, and the current encoder cycle Tn is estimated. However, it is possible to use an calculation formula that uses the ratio (for example, output value "c=b·b/a") between the previous encoder cycle Tn−1 (=b) and the last but one previous encoder cycle Tn−2 (=a).

That is, it is possible to adopt a proper arithmetic expression in which, the encoder cycle can be estimated to be shorter than the previous encoder cycle in the accelerating region and the encoder cycle can be estimated to be longer than the previous encoder cycle in the deceleration region. Further, the invention is not limited to the case in which the last but one previous encoder cycle and the previous encoder cycle are used. For example, three encoder cycles such as the last but two previous, the last but one previous, and previous encoder cycles can be used. Further, an arithmetic expression which uses the last but three or more previous cycles can be adopted. In addition, the encoder cycle used in the arithmetic expression is not limited to an arithmetic expression using a plurality of continuous encoder cycles such as the last but one previous encoder cycle and the previous encoder cycle. For example, the last but two previous encoder cycle and the previous encoder cycle can be used. When using three or more cycles before encoder cycle, it is possible to adopt an arithmetic expression capable of calculating the current encoder cycle by using the difference of the last but one previous encoder cycle δ(n−2) and difference of previous encoder cycle δ(n) so as to determine a tendency of the acceleration velocity change. For example, for the output value "c", there can be adopted an arithmetic expression such as "c=[b−(a−b)]·δ(n−1)/δ(n−2)" or "c=b−{(a−b)−[δ(n−2)−δ(n−1)]}, where (a−b) is difference of current encoder cycle δ(n).

In the above embodiments, the cycle measuring values, which are used when the estimated encoder cycle is calculated, are a plurality of cycle measuring values whose measuring cycles are different from one another, but the velocity variation may be reflected on the estimated encoder cycles. For example, while the moving body is accelerated, the prescribed value "g" may be subtracted from the previous cyclic count value "b" (output value c=b−g), and while the moving body is decelerated, the prescribed value may be added to the previous cyclic count value "b" (output value c=b+g). In this case, the prescribed value may be set to a different value for each velocity region such that the prescribed value becomes a smaller value in the higher velocity region, and the prescribed value may be set to the ratio of the previous cyclic count value. For example, when the moving body is accelerated, the value is set to the output value "c=b−b·k", and when the moving body is decelerated, the value is set to the output value "c=b+b·k" (here, 0<k<1). That is, an calculation formula may be used in which acceleration is reflected. In this case, the acceleration being reflected means that the acceleration does not need to be reflected to be exact, and as described above, and the acceleration may be reflected by tendency (in the course of the acceleration, it is smaller than the previous cyclic count value "b", and in the course of the deceleration, it is larger than the previous cyclic count value "b").

In the third embodiment, the delay signal DS that is the third pulse signal has a cycle that varies according to the acceleration and the deceleration. However, the delay signal DS in one cycle of the internal timing signal may be a constant cycle. In the fourth embodiment, on the basis of the estimated encoder cycle Tj+1, the calculator 91 that serves as a corrector operable correct the delay setting value Dm several times during the current encoder cycle, and sets the corrected delay setting value Dn several times. As in the second embodiment, during the current encoder cycle, one corrected delay setting value Dn may be set. Even in this structure, since at least the internal timing signal TS have the cycle that varies according to the carriage velocity variation, it is possible to generate the print timing signal with high precision.

In this third and fourth embodiments, the previous encoder cycle Tj (measured encoder cycle) is measured, and the current encoder cycle Tj+1 (estimated encoder cycle) is obtained by referring to the table 96 on the basis of the measured encoder cycle Tj. However, when obtaining the estimated encoder cycle, it is not necessary to the measured cycle. For example, it is possible to use the structure in which the previous position pj+1 is obtained, and the estimated encoder cycle Tj+1 corresponding to the current position Pj+1 can be obtained by referring to the table 96 on the basis of the current position pj+1.

In the first and second embodiment, it is possible to use the structure in which the calculator 79 and the table 97 used in the third and fourth embodiments are additionally provided, and the internal timing signal TS and the ejection timing signal PTS whose cycles are varied according to the acceleration and deceleration are generated. Further, in the structure of the first embodiment, it is possible to use the structure in which the calculator 79 and the table 97 used in the third embodiment are additionally provided, and the first delay signal DS1 whose cycle is varied according to the acceleration and deceleration is generated. Further, in the modification in which the calculator 79 and the table 97 are additionally provided in the second embodiment, it is possible to configure such that the calculator 91 (FIG. 12) and the table 99 according to the fourth embodiment are used instead of the calculator 91 (FIG. 8), and the delay setting value Dm is corrected by the value according to the cycle of the internal timing signal TS whose cycle is varied according to the acceleration and the deceleration.

The encoder is not limited to a linear encoder 23. For example, the encoder may be a rotary encoder that detects the rotation of the carriage motor 13. Further, an absolute encoder may be used as the encoder.

In the above embodiments, the print timing signal PTS is generated by using the circuit on which the velocity variation is reflected using the same calculation formula in the accelerating and decelerating regions and the constant velocity region. However, the circuit may be used only in the accelerating and decelerating regions and another circuit on which the velocity variation is not reflected may be used in the constant region.

In the above embodiments, the ink jet printer 10 is described in detail as an example of the liquid ejecting apparatus. However, the invention is not limited thereto. It is possible to embody a liquid ejecting apparatus which ejects the liquid (including liquid in which particles of functional material are distributed) other than the ink. For example, the liquid ejecting apparatus may be a liquid ejecting apparatus which ejects liquid in which a material, such as an electrode material or a color material, used for manufacturing a liquid crystal display, EL (electroluminescence) display, or surface emission display, is distributed or melted, a liquid ejecting apparatus which ejects a bioorganic substance used for manufacturing a biochip, or a liquid ejecting apparatus which ejects liquid to be a sample used as a precision pipette. At least one of the above-described liquid ejecting apparatus may be adapted to the invention.

The disclosure of Japanese Patent Application Nos. 2005-314690 filed Oct. 28, 2005; 2005-314691 filed Oct. 28, 2005; and 2006-291113 filed Oct. 26, 2006 including specifications, drawings and claims are incorporated herein by reference in their entirety.

What is claimed is:

1. A signal generating device, adapted to be installed in a liquid ejecting apparatus which comprises a liquid ejector operable to eject liquid and a carriage operable to carry the liquid ejector, the signal generating device comprising:

a first generator, operable to generate first pulse signals at first intervals corresponding to a velocity of the carriage which moves with a variable acceleration;

an estimator, operable to estimate a second interval which is an interval of the first pulse signals which will be generated by the first generator based on a variation of an acceleration of the carriage as a second interval;

a timing signal generator, operable to generate a timing signal determining a timing at which the liquid is ejected from the liquid ejector, based on the second interval:

a first divider, operable to divide the second interval into a plurality of third intervals, each of which is a time period to which a first correction is applied based on the variation of the acceleration;

a second generator, operable to generate second pulse signals at the third intervals, wherein the timing signal generator is operable to generate the timing signal based on the second pulse signals;

a second divider, operable to divide the second interval into a plurality of fourth intervals, each of which is a time period to which second correction is applied based on the variation of the acceleration;

a fourth generator, operable to generate third pulse signals at the fourth intervals;

a storage, operable to store a delay value indicative of a delayed amount of the second pulse signals;

a delay provider, operable to count a number of the third pulse signals, and operable to delay each of the second pulse signals for a time period that the number of the third pulse signals counted by the delay provider is reached to the delay value.

2. A liquid ejecting apparatus, incorporating the signal generating device as set forth in claim 1, comprising:

a controller, operable to cause the liquid ejector to eject the liquid in accordance with the timing signal at least when the velocity of the carriage changes.

3. The signal generating device as set forth in claim 1, wherein the estimator is operable to obtain the second interval based on a profile data including a table in which each of intervals is corresponded to a position of the carriage in the liquid ejector.

4. The signal generating device as set forth in claim 1, further comprising:

a fourth pulse signals generator, operable to count a time, and operable to generate a fourth pulse signal at every time when the time counted by the fourth pulse signal generator reaches the third intervals, wherein the first correction is applied at every time when the fourth pulse signal is output.

5. The signal generating device as set forth in claim 1, further comprising:

a fourth pulse signals generator, operable to count a time, and operable to generate a fourth pulse signal at every time when the time counted by the fourth pulse signal generator reaches the third intervals, wherein the first correction is applied when the fourth pulse signal is output predetermined times.

6. The signal generating device as set forth in claim 1, further comprising:

a fifth pulse signals generator, operable to count a time, and operable to generate a fifth pulse signal at every time when the time counted by the fifth pulse signal generator reaches the fourth intervals, wherein the second correction is applied at every time when the fifth pulse signal is output.

7. The signal generating device as set forth in claim 1, further comprising:

a fifth pulse signals generator, operable to count a time, and operable to generate a fifth pulse signal at every time when the time counted by the fifth pulse signal generator reaches the fourth intervals, wherein the second correction is applied when the fifth pulse signal is output predetermined times.

8. A liquid ejecting apparatus, comprising:

a liquid ejector configured to eject liquid;

a carriage carrying the liquid ejector and configured to move in a variable acceleration when the liquid ejector ejects liquid;

a signal generating device comprising:

a first generator, configured to generate first pulse signals at first intervals corresponding to a velocity of the carriage which is moving in a variable acceleration;

an estimator, configured to estimate an estimated variation of the variable acceleration in which the carriage is moving, and to estimate a second interval which is an interval of the first pulse signals based on the estimated variation of the variable acceleration of the carriage as a second interval;

a timing signal generator, configured to generate a timing signal determining a timing at which the liquid is ejected from the liquid ejector, based on the second interval and:

a controller configured to cause the liquid ejector to eject the liquid in accordance with the timing signal; a first divider, operable to divide the second interval into a plurality of third intervals, each of which is a time period to which a first correction is applied based on the variation of the acceleration; a second generator, operable to generate second pulse signals at the third intervals, wherein the timing signal generator is operable to generate the timing signal based on the second pulse signals; a second divider, operable to divide the second interval into a plurality of fourth intervals, each of which is a time period to which second correction is applied based on the variation of the acceleration; a fourth generator, operable to generate third pulse signals at the fourth intervals; a storage, operable to store a delay value indicative of a delayed amount of the second pulse signals; a delay provider, operable to count a number of the third pulse signals, and operable to delay each of the second pulse signals for a time period that the number of the third pulse signals counted by the delay provider is reached to the delay value.

9. The liquid ejecting apparatus as set forth in claim 8, wherein the signal generating device further comprises:

a first divider, configured to divide the second interval into a plurality of third intervals, each of which is a time period to which a first correction is applied based on the variation of the acceleration; and a second generator, configured to generate second pulse signals at the third intervals;

wherein the timing signal generator is configured to generate the timing signal based on the second pulse signals.

10. The liquid ejecting apparatus as set forth in claim 9, wherein the signal generating device further comprises:

a second divider, configured to divide the second interval into a plurality of fourth intervals, each of which is a time period to which a second correction is applied based on the variation of the acceleration;

a fourth generator, configured to generate third pulse signals at the fourth intervals;

a storage, configured to store a delay value indicative of a delayed amount of the second pulse signals; and a delay provider, operable to count a number of the third pulse signals, and configured to delay each of the second pulse signals for a time period that the number of the third pulse signals counted by the delay provider is reached to the delay value.

11. The liquid ejecting apparatus as set forth in claim 10, wherein the signal generating device further comprises:

a fifth pulse signals generator, configured to count a time, and configured to generate a fifth pulse signal when the time counted by the fifth pulse signal pulse signal generator reaches the fourth intervals;

wherein the second correction is applied when the fifth pulse signal is output.

12. The liquid ejecting apparatus as set forth in claim 10, wherein the signal generating device further comprises:

a fifth pulse signals generator, configured to count a time, and configured to generate a fifth pulse signal when the time counted by the fifth pulse signal pulse signal generator reaches the fourth intervals;

wherein the second correction is applied when the fifth pulse signal is output at predetermined times.

13. The liquid ejecting apparatus as set forth in claim 9, wherein the signal generating device further comprises:

a fourth pulse signals generator, configured to count a time, and configured to generate a fourth pulse signal when the time counted by the fourth pulse signal pulse signal generator reaches the third intervals;

wherein the first correction is applied when the fourth pulse signal is output.

14. The liquid ejecting apparatus as set forth in claim 9, wherein the signal generating device further comprises:

a fourth pulse signals generator, configured to count a time, and configured to generate a fourth pulse signal when the time counted by the fourth pulse signal pulse signal generator reaches the third intervals;

wherein the first correction is applied when the fourth pulse signal is output at predetermined times.

15. The liquid ejecting apparatus as set forth in claim 8, wherein the estimator is configured to obtain the second interval based on a profile data including a table in which each of the first intervals correspond to a position of the carriage in the liquid ejector.

* * * * *